United States Patent [19]

Kircher et al.

[11] 4,324,634

[45] Apr. 13, 1982

[54] REMOTELY CONNECTING AND DISCONNECTING CELLS FROM CIRCUIT

[75] Inventors: Morton S. Kircher, Clearwater, Fla.; Steven J. Specht, Mentor, Ohio

[73] Assignee: Olin Corporation, New Haven, Conn.

[21] Appl. No.: 116,366

[22] Filed: Jan. 28, 1980

Related U.S. Application Data

[63] Continuation-in-part of Ser. No. 93,425, Nov. 13, 1979.

[51] Int. Cl.[3] ..... C25B 15/00; C25B 9/04

[52] U.S. Cl. ..... 204/228; 204/253; 204/267

[58] Field of Search ..... 204/228, 253–258, 204/263–266, 267–270, 279

[56] References Cited

U.S. PATENT DOCUMENTS

| | | | |
|---|---|---|---|
| 2,433,209 | 12/1947 | Forbes | 204/253 |
| 2,649,510 | 8/1953 | Michaelis | 204/228 X |
| 3,432,422 | 3/1969 | Currey | 204/258 |
| 3,700,582 | 10/1972 | Giacopelli | 204/266 X |
| 3,738,122 | 1/1974 | Sato et al. | 204/279 |
| 3,859,196 | 1/1975 | Ruthel et al. | 204/279 X |
| 3,930,978 | 1/1976 | Strewe et al. | 204/228 |
| 4,078,984 | 3/1978 | Strewe | 204/228 |
| 4,227,987 | 10/1980 | Kircher et al. | 204/267 X |

FOREIGN PATENT DOCUMENTS

| | | | |
|---|---|---|---|
| 2055161 | 5/1971 | Fed. Rep. of Germany | 204/228 |

*Primary Examiner*—Delbert E. Gantz
*Assistant Examiner*—Donald R. Valentine
*Attorney, Agent, or Firm*—Ralph D'Alessandro; Donald F. Clements; Thomas P. O'Day

[57] ABSTRACT

A process for electrically by-passing one of a series of electrolytic cells without interrupting current flow through the remaining cells is disclosed. The process includes inserting two conductors between the cells, remotely moving the conductors into pressurized contact with the cell preceding and the cell following the cell being disconnected and closing a switch to electrically connect the two conductors thereby by-passing the cell being disconnected.

47 Claims, 24 Drawing Figures

FIG-17
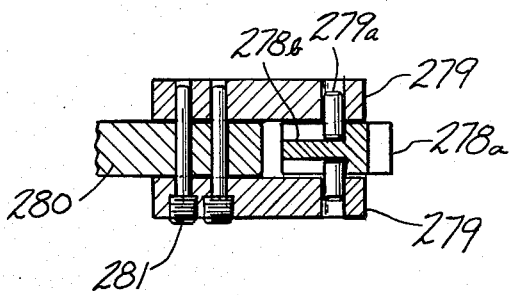
FIG-16
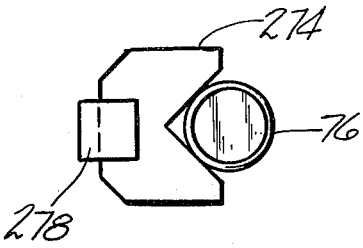
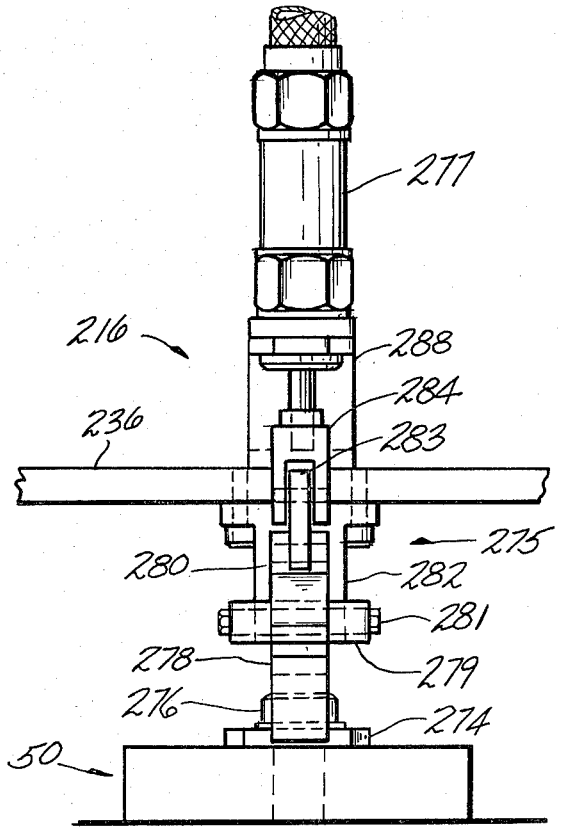
FIG-15
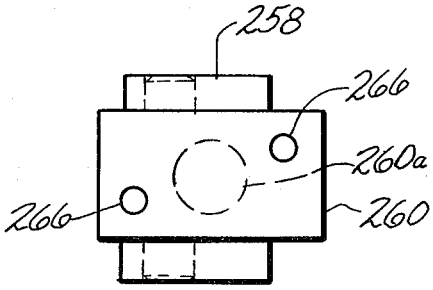
FIG-18

REMOTELY CONNECTING AND DISCONNECTING CELLS FROM CIRCUIT

This is a continuation-in-part of U.S. Patent Application Ser. No. 093,425, filed Nov. 13, 1979, entitled "Automatic Tightener/Loosener For Intercell Electrical Connectors".

This invention relates to processes for connecting and disconnecting electrolytic cells from a series electrical circuit, such as in a chloralkali plant.

In order to minimize the amount of space and material required to conduct electrical current within commercial electrolytic cell plants, it is preferred to operate electrolytic cells at the highest practical safe voltage. For chloralkali cells, 400 volts is widely considered such a safe maximum. Also, for maximum technical and economic efficiency, it is preferred that the current capacity (production capacity) have a certain relationship with the total plant production required, i.e. to have one or two circuits of cells provide the entire plant production capacity. Chloralkali plant capacity has increased from 300 tons of chlorine per day typical for the year 1960 to 1,000 tons of chlorine per day typical for the year 1977, and preferred current capacity for diaphragm cells has increased from 30,000 amperes to 150,000 amperes. In fact, there is currently justification for cells of 300,000 amperes of capacity.

Two different approaches have been taken to provide time out of production for cell maintenance. One is to shut down an entire cell circuit for maintenance (sometimes preferred when a large number of circuits are available). The other, more usual method, is to by-pass current around one cell at a time, and to replace the by-passed cell with a spare cell already reconditioned. It is the latter method with which the invention is concerned. The design of cells for maximum economy favors the shortest current path within the cells and in the connections between the cells. Capital charges on the installed cost of conductors and power cost for the power losses in the conductors are approximately equal factors in the economic considerations.

It has been a perpetual problem with electrolytic cells how to safely and efficiently disconnect and reconnect such cells from one another, especially when such cells are connected in an electrical series circuit in order to take one or more cells out of such circuit for maintenance or replacement. Disconnection and reconnection is preferably made as rapidly as possible in order that other cells in the circuit can be run as much of the time as possible. In fact, the normal practice in most electrochemical plants is to attach one or more jumper switches around the electrolytic cell to be disconnected so that it can be electrically by-passed and then disconnected and later reconnected without shutting down the other cells in the circuit. To allow such disconnection and reconnection, electrolytic cells are generally connected to one another by means of a removable intercell connector. In order to move such an intercell connector, it is desirable to have some means for controlling its movement so that the cells can be closely spaced, i.e. connected with a minimal amount of space therebetween, and yet operator safety can be better assured.

With the larger new cells and with enhanced awareness of safety, it has become a major problem to design processes for short-circuiting and removing cells. Attempts which have been made to date have not been fully successful because of high costs of construction and retained hazardous features. The cell disclosed in U.S. Pat. No. 3,859,196, by Ruthel and Evans, issued Jan. 7, 1975, to Hooker Chemicals and Plastics Corporation provides heavy copper reinforcements to the anode conductors and cathode conductors of each cell to bring terminals forward so that the short-circuiting switch can be connected by workmen standing in the aisle in front of the cells. A large number of long intercell connectors between cells must be removed manually. This system is expensive in extra copper and expensive in power loss due to the long connections between cells. Also, the Hooker (Ruthel et al) system requires heavy manual work between cells, which is a retained safety hazard.

Freidrich Uhde GmbH attempted to overcome the disadvantages of Ruthel and Evans by developing the device disclosed in U.S. Pat. No. 3,930,978, by Strewe et al, issued Jan. 6, 1976. Strewe et al used an increased length-width ratio for the cell and attached the short circuiting switch under the cell, using a cell room with two floors. The Strewe solution saves the cost of extra copper within the cell but has added disadvantages of requiring an extra floor in the cell building and an elaborate cell support structure underfloor and of requiring switch connections to be made overhead in a hazardous location.

For older, smaller (40 KA or less) cells the connection method disclosed in U.S. Pat. No. 3,432,422 by Currey, issued Mar. 11, 1969, to Hooker Chemical Corporation was widely used. The current path during short circuiting approached the minimum, as is desirable and also no extra copper was provided for attachment of the short circuiting switch. Curry provided dual anode and cathode terminals which were all in service during normal cell operation. To by-pass the cell, one anode terminal and one cathode terminal from the cell immediately preceding and the cell immediately following the cell being by-passed are disconnected from the cell to be by-passed and are instead attached to the jumper switch arm for short circuiting. Then the other terminals are disconnected. However, this Currey system required heavy manual work between or adjacent to cells to disconnect connectors and thus required extra floor space for safe movement of workers and hence increased construction costs. The Currey system also required a heavy extra bus bar to connect the cathode terminals during short circuiting and, unevenly, supplied current to only one of the anode terminals of the following cells.

Sato and Inoy in U.S. Pat. No. 3,783,122, which issued Jan. 1, 1974, to Showa Denko Kabushiki Kaisha, alleged solution of the extra space requirement of the Currey connection method by adding extra copper to the anode and cathode terminals of the cell to extend the terminals forward into the aisle alongside the cells. Space is saved between cells and connections are more accessible. However, since in the Sato design, current must be collected and taken to the front and back of the cell, either the terminals have to be enormous or expensively cooled or both when used on the large capacity cells presently being designed and built. The previously mentioned cell of Ruthel also requires an expensive and elaborate terminal and cooling system.

Intercell connectors present problems all their own, regardless of the type of jumper switch used. A number of intercell connectors are known to the prior art. One of the most commonly used intercell connectors is the type of intercell connector shown in the Currey patent mentioned above. That intercell connector includes an L-shaped conductor which is clamped to both the anode bus bar of a first cell and the cathode bus bar of a second cell. The L-shaped conductor is aligned so that the portion clamped to the cathode bus bar is vertical while that portion connected to the anode bus bar of the following cell is horizontal. This method of connection is suitable for cells having relatively low current capacity in comparison to the more recent developed cells which now commonly carry upwards of 150 kiloamperes current. The intercell connector system shown in the Currey patent is not suitable for larger cells because it would require enormous bus bars to enable even current distribution during jumping and because the disconnection of the L-shaped conductor must be made between cells and this would be hazardous without some apparatus not shown in the Currey patent if the cells of the Currey patent are modified so as to carry larger amounts of current. In particular, the cell disclosed in Currey would have to be modified by the addition of either more terminals, much thicker terminals, or some other modification in order to carry currents much over 40 kiloamperes. Furthermore, the L-shaped conductor disclosed in Currey must be completely removed in order to disconnect the cells from one another and this would prove very difficult with the size of L-shaped conductor which would be necessary for larger cells. Furthermore, the space between the cells in the Currey patent is so restricted that if more than two sets of terminals are provided, it would be extremely difficult to manipulate any sort of wrench between the cells.

The problem of redesigning the cell disclosed in the Currey patent to handle larger capacity has led the manufacturer of that cell to develop the cell disclosed in the Ruthel et al patent mentioned above. The cell of Ruthel includes costly water-cooled extensions to both the anode terminal and cathode terminal to bring the terminals out into an aisle adjacent a series of such cells so that a cell can be electrically by-passed by connecting the cell preceding the cell being by-passed to the cell following the cell being by-passed, such connection being done by means of a jumper device located entirely in the aisle. This has necessarily resulted in a rather complex cell structure and lots of extra expensive conductive material for the sole purpose of "jumping" the cell. The terminal extensions are termed by Ruthel as "lead-in bus bar" (cathode terminal extension) and "anode plate" (anode terminal extension), respectively. This extra copper and extra coolant channels are obvious expenses of the cell design of Ruthel and there is a need in the art for a cell design which eliminates these extra coolant channels and extra copper (or other conductive material) but which is still able to handle high current capacity cells.

The conventional mechanism for loosening and tightening electrical connectors between electrolytic cells is to manually apply a wrench to bolts holding such electrical connectors to the cell terminals of the cells from which the electrical connector is to be loosened or tightened. However, in order to conserve materials and energy, it is desirable to place electrolytic cells sufficiently close together that manual loosening and tightening of electrical connectors between such cells is made increasingly difficult. Various method have, in the past, been proposed for solving this problem.

One such method is to add additional metal to the cell terminals so that the cell terminals are brought laterally forward into an aisle along such cells and then disconnecting the cells from one another in that aisle by manual means. One example of such a method is disclosed in U.S. Pat. No. 3,783,122, by Sato et al issued Jan. 1, 1974.

An alternate method previously proposed is that which is disclosed, the Strewe et al patent mentioned above. The Strewe et al patent discloses elevating the electrolytic cell so that access can be had to the intercell connectors from below the travel of the electrolytic cell. However, this is quite expensive in that it requires an extra floor in the cell plant and requires construction of a substantial cell support framework system to hold the electrolytic cells in such an elevated position.

There is a need for a method for loosening and tightening electrical connections between cells without requiring manual operations between such cells. There is need for a remote-control method of electrically by-passing cells from both this safety standpoint and from a material and energy conservation standpoint as well, since it is a current problem in the art that the connections between cells presently requires so much extra conductor metal or a complex cell plant designed to elevate the cells for access from below.

There is a need for a method for taking large capacity diaphragm cells out of service which does not require the addition of a large amount of extra conductor on each cell solely for the short-circuiting requirement, which does not require an extra floor in the cell building, and which does not require personnel access into hazardous locations for switch attachment or cell disconnection.

Therefore, it is an object of the present invention to provide a method for "jumping" (by-passing) cells having a rated capacity of 130,000 to 500,000 amperes. It is a further object of the invention to provide a process for connecting electrolytic cells in a manner which enables by-pass of one of the cells while still providing a current path for normal operation between the cells which is close to the minimum possible.

It is a still further object of the invention to provide a method of using an intercell conductor and an intercell conductor in combination for optimum normal operation without excess metal being required for short-circuiting purposes.

It is a further object of the invention to provide method for short-circuiting individual cells and removing them without entry of personnel between or under cells. It is a further object of the invention to provide a method for entering between cells and making long, narrow electrical contact with the appropriate cell terminals and carrying the full cell current at a conservating rating and including steps for making fast the connections by a remotely controlled mechanism.

It is a further object of the invention to make lengthy contact with at least one-third the length of the cell terminals to which they are connected.

It is a further object of the invention to apply pressure on the contact surfaces and release pressure by remote control.

It is a further object of the invention to remove the intercell connectors in conjunction with the cell removal, without requiring entry of personnel between cells.

It is another object of the invention to clean contact surfaces on the terminals between cells without requiring personnel entry.

These objects are achieved by the present invention which provides a method of by-passing and disconnecting one of a plurality of electrolytic cells connected in electrical series while maintaining the remaining cells of said electrical series in operation, each of said cells having a cathode terminal, an anode terminal, and an intercell conductor for electrically connecting said anode and cathode terminals, which method comprises the steps of:

(a) positioning a jumper aside said series of cells;

(b) extending a first portion of said jumper between a cell to be disconnected and the preceding cell in said series of cells;

(c) extending second portion of said jumper between said cell to be disconnected and the succeeding cell in said series of cell;

(d) contacting cathode terminal of said preceding cell with said first portion of said jumper at a location between said preceding cell and said cell to be disconnected while said cell to be disconnected in still fully connected to said preceding cell;

(e) contacting the anode terminal of said succeeding cell with said second portion of said jumper at a location between said succeeding cell and said cells to be disconnected while said cell to be disconnected is still fully connected to said succeeding cell;

(f) electrically connecting said first and second jumper portions so as to electrically by-pass said cell to disconnected; and (g) remotely disconnecting said cell to be disconnected from said preceding and succeeding cells to thereby electrically by-pass said disconnected cell through said jumper.

The objects and advantages of the present invention will be better understood by reference to the attached drawings, in which.

Figure 13:
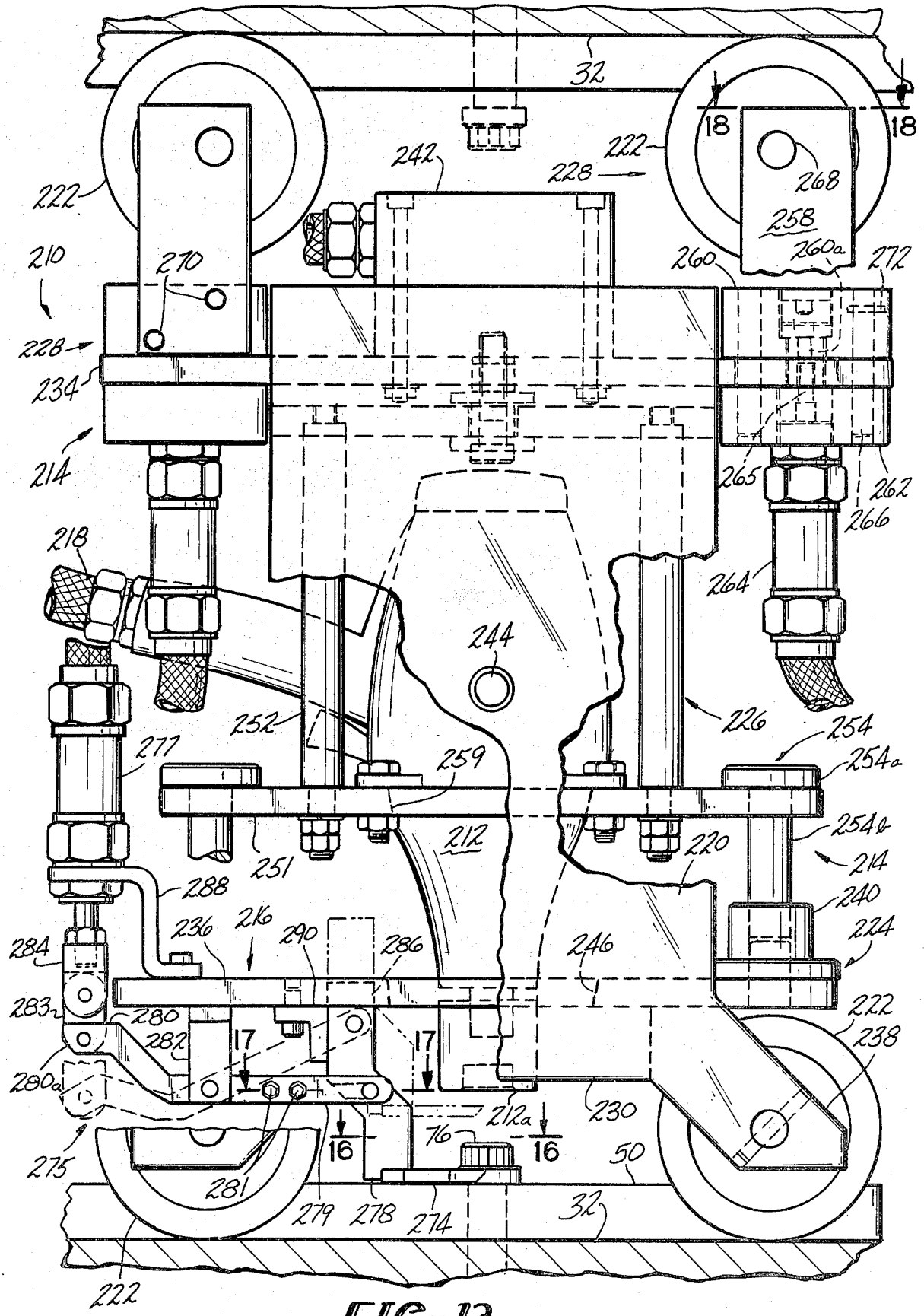
FIG. 13 is a side-elevational view with portions cut away, showing the intercell portion of a pneumatic bolt tightener/loosener which can be moved between the electrolytic cells as a part of the method of the invention.
Figure 19:
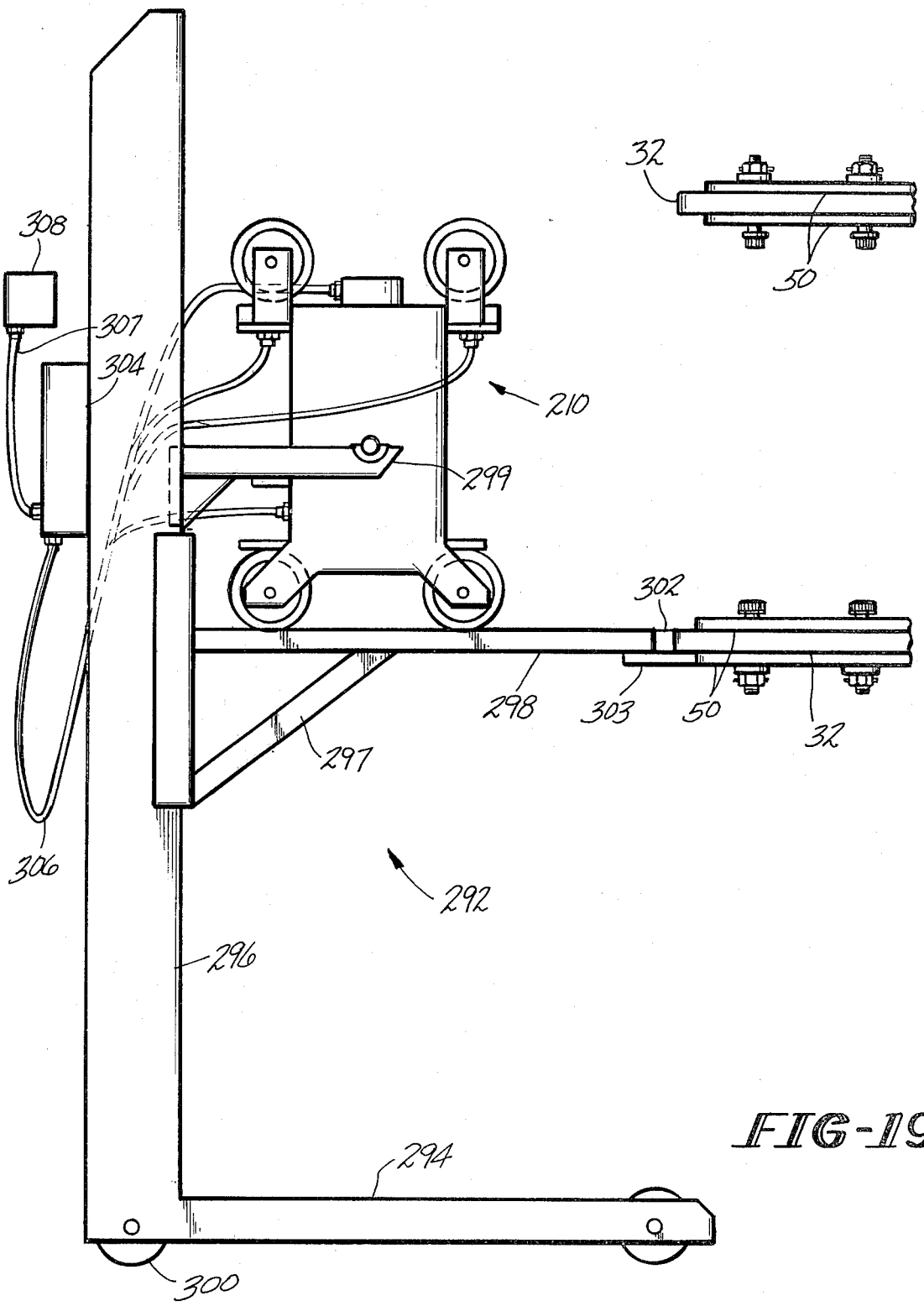
Figure 20:
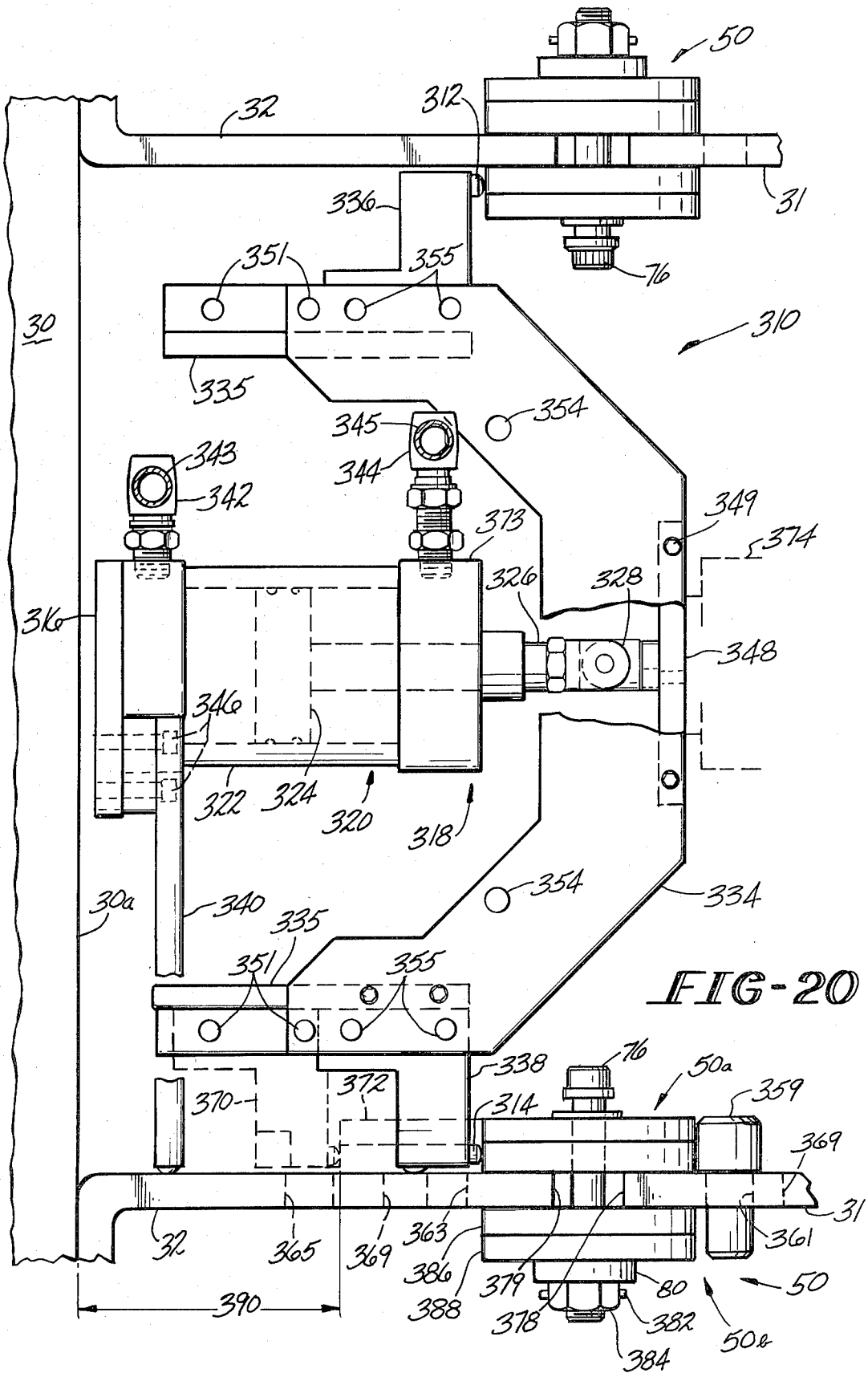
Figure 21:
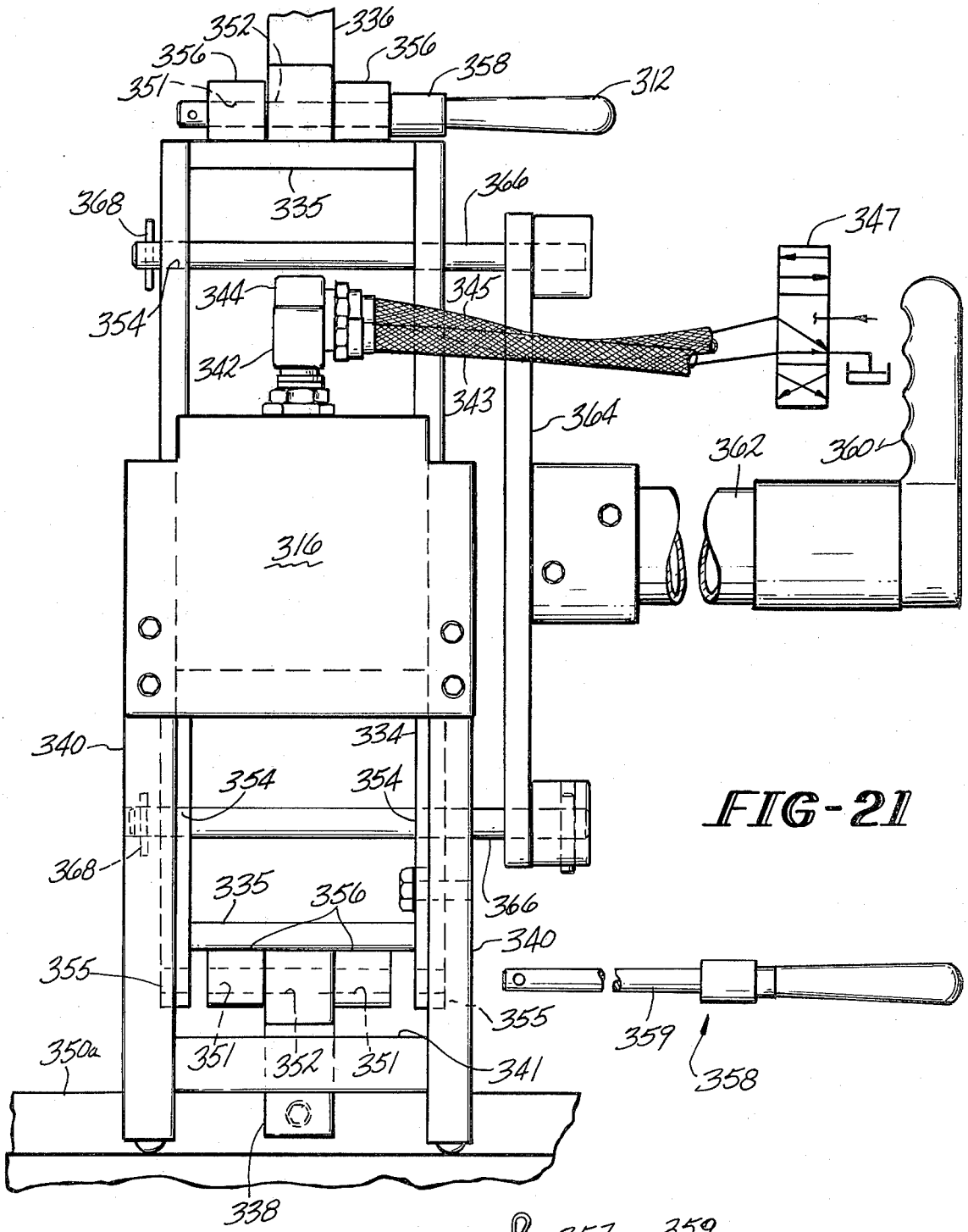
Figure 22:
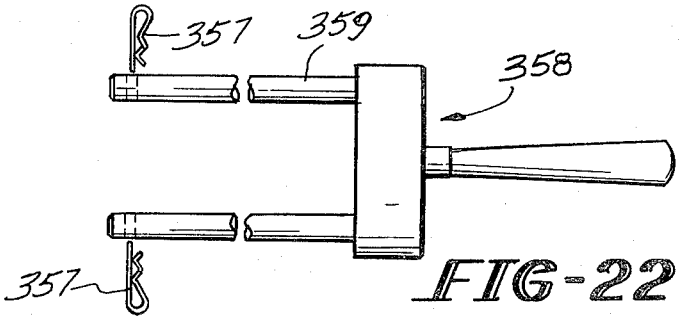
Figure 23:
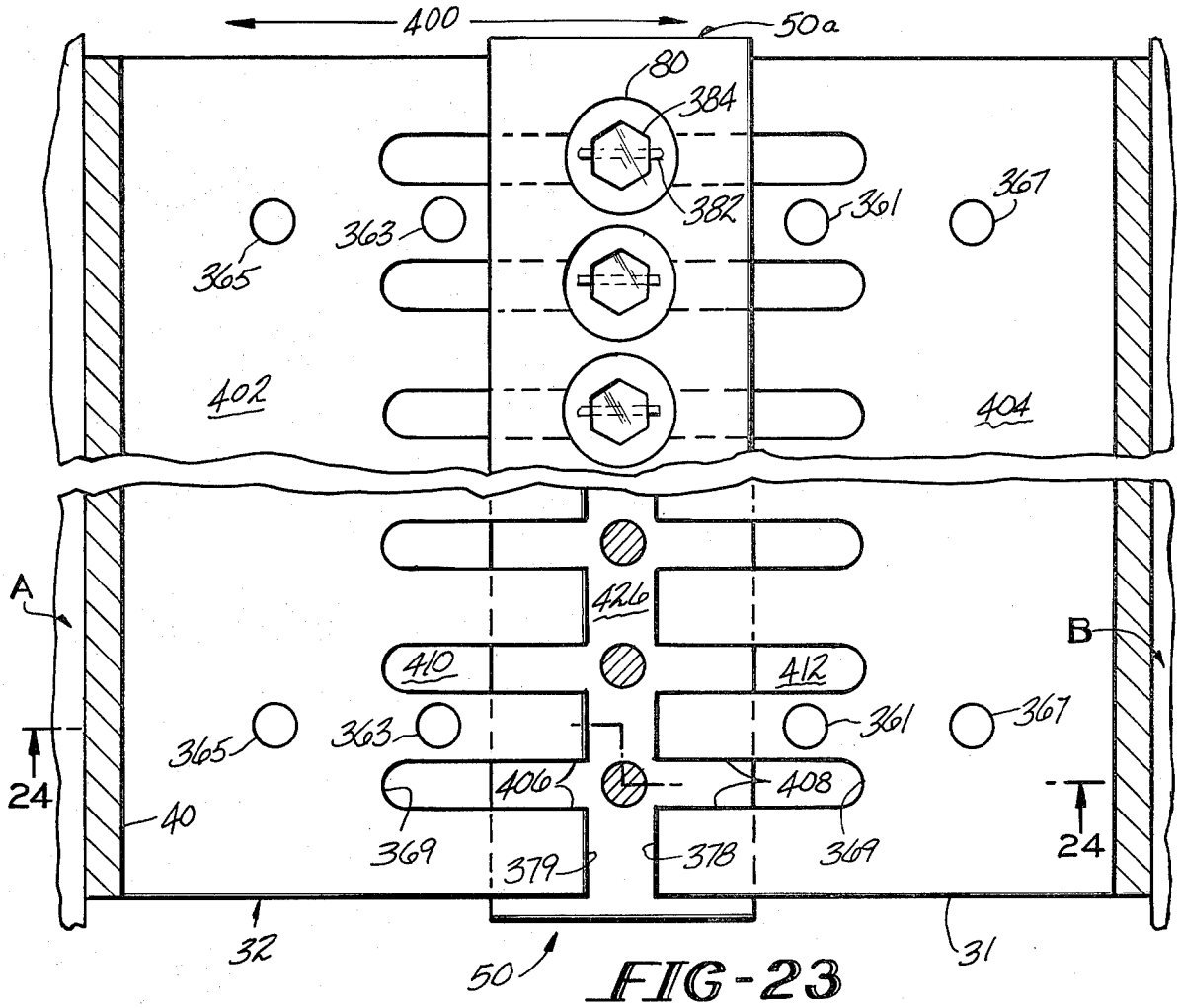
Figure 24:
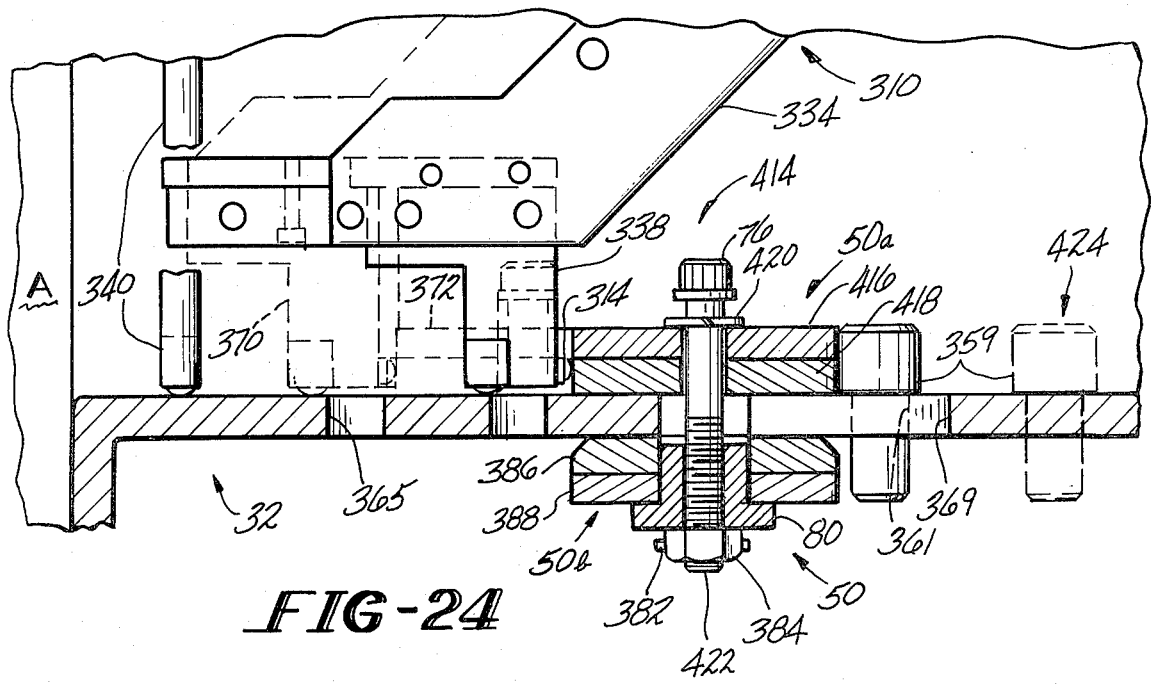

FIG. 15 is a rear-elevational view of the locater means or "indexing latch" of FIG. 13, FIG. 16 is a horizontal, cross-sectional view looking downward through the bolt-finding, notched foot of the indexing latch of FIG. 15 taken along lines 16—16 of FIG. 13, FIG. 17 is a stepped, horizontal, cross-sectional view looking downward through a portion of the indexing latch of FIGS. 13 and 15 taken along lines 17—17 of FIG. 13;

FIG. 18 is a top planar view of a wheel and brake assembly of FIG. 13 taken along lines 18—18 of FIG. 13;

FIG. 19 is a side-elevational view of a dolly and control means which can be used in association with the portion of the invention shown in FIGS. 13–18;

FIG. 20 is a front elevational view of an intercell jack for use in the method of the invention shown in a position following its use to move an intercell connector from a disengaged position (dotted lines) to the engaged position shown;

FIG. 21, is a side-elevational view of the jack of FIG. 20, further including a handle and pole used before and after intercell positioning of the jack and a pin fork used for presetting the lateral intercell position of the jack;

FIG. 22 is a top plan view of the pin fork of FIG. 21;

FIG. 23 is a top plan view partially in section and partially from above showing two adjacent terminals of two adjacent cells with a laterally slidable intercell connector in a position connecting the terminals; and FIG. 24 which is a side elevational view partly in section, showing the intercell connection system of FIG. 23 and also showing the lower part of the jack of FIG. 20 which can be remotely operated to move the intercell connector of the system.

DETAILED DESCRIPTION OF BEST MODE

Figure 1:
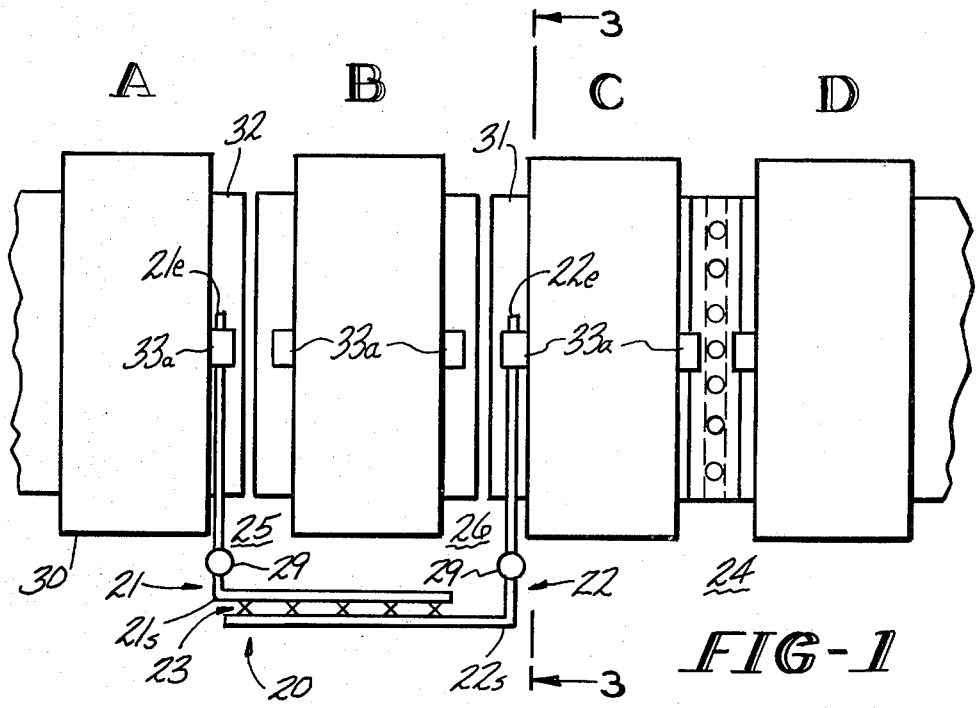
FIG. 1 is a top, plan view of a series of four electrolytic cells connected in electrical series, showing the connection to the cells of a preferred jumper switch which can be used in the method of the invention.
Figure 2:
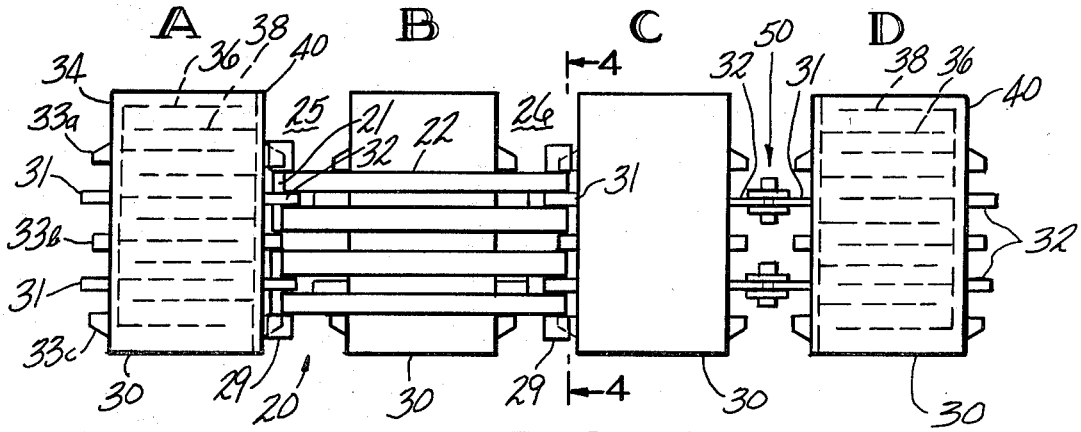
FIG. 2 is a side, elevational view of the cell series of FIG. 1 showing the connection of the cell terminals with the jumper system of FIG. 1.

FIG. 1 is a plan view of a series of four electrolytic cells A, B, C, and D. The reference numbers of all figures refer to the same parts unless otherwise indicated. A jumper system 20 is provided in order to help disconnect cell B from cells A, C, and D. Jumper system 20 comprises a first L-shaped conductor 21, a second L-shaped conductor 22, a mover means 29, lever lugs 33*a*, 33*b*, 33*c*, (see FIG. 2) on cells A, B, and C, and a switch means 23 for selectively, electrically connecting conductor 21 and 22 together. FIG. 2 is a side view of system 20 and cells A–D. Each of cells A, B, C, and D is comprised of a cell body 30, two anode terminals 31, two cathode terminals 32, and six "lever lugs" 33*a*, 33*b*, 33*c*. Cells A, B, C, and D could have more than two or less than two anode terminals and more than two or less than two cathode terminals if desired. Lever lugs 33*a*, 33*b*, 33*c* serve to hold the free ends 21*e*,22*e* (see FIG. 1) of conductors 21 and 22 to prevent the free ends of the conductors 21 and 22 from pivoting out of contact with terminals 32 and 31 when the switch ends 21*s*,22*s* of conductors 21 and 22 are moved toward each other as described below. In order to disconnect cell B from cells A and C, it is first necessary to electrically connect cathode terminals 32 of cell A to anode terminal 31 of cell C so that when cell B is disconnected, electrical flow through cells A, C, and D is not interrupted. It is not desirable to interrupt the current flow through cells A, C, and D since such interruption would obviously decrease the amount of production which could be obtained from cells A, C, and D during the time cell B is disconnected. Since present day chloralkali cells may generate as much as 5 tons per day or more of product, it is of extreme economic importance not to miss any more production time than is absolutely necessary. This is especially true where a circuit of cells comprises 50 or 100 or more of such cells in electrical series. A shut-down of a couple of days in such a circuit would mean hundreds of thousands of dollars of lost production. Jumper system 20 is located in aisle 24 (see FIG. 1) adjacent cells A, B, C, and D with conductors 21 and 22 projecting into the spaces 25, 26 between cells A and B and cells B and C respectively.

FIGS. 1 and 2 also show the electrical by-pass circuit established by engagement of jumper system 20 with cells A and C. Cells A,B,C, and D are connected in electrical series and have vertical electrodes lying parallel to the direction of overall current flow through the series. That method saves on the amount of copper needed to connect the cells and on the amount of copper needed to allow for by-passing of cells. Current from any suitable electrical DC power source is provided to anode terminal 31 of cell A and flows in conventional manner from anode terminal 31 of cell A to an anode current distributor 34 to anode conductor rods 36 to an anode surface (not shown) through an electrolyte and diaphragm or membrane (not shown) to a cathode surface (not shown) to cathode conductor rods 38 to a cathode current collector 40 to cathode terminals 32 to conductor 21. Similarly, current selectively flows through switch 23 (see FIG. 1) to conductor 22 to anode terminal 31 of cell C and through a similar anode current distributor, anode conductor rods, anode surface, electrolyte, membrane or diaphragm, cathode surface, cathode conductor rod, cathode collector to cathode terminal 32 of cell C. From cathode terminal 32 of cell C, current flows through intercell connector 50 to anode terminals 31 of cell D, through cell D in similar fashion to that through cell C and then to cathode terminals 32 of cell D and from cathode terminal 32 to any suitable electrical means for completing the circuit. It is therefore apparent that the electrical flow has bypassed cell B via system 20. In FIG. 1, conductors 21 and 22 contact terminals 32 of cell A and terminal 31 of cell C over a length at least one third the length of those cell terminals 31 and 32. As respects the cells and terminals "length" as used herein refers to the direction transverse (i.e. up and down in both FIGS. 1 and 2) to the overall current flow direction (left to right in FIGS. 1 and 2), since cells A, B, C, and D are preferably longest in that transverse or "length" direction and since that is the direction in which conductors 21 and 22 extend between cells. This optional "length" of contact is desirable in order to minimize the amount of current which terminals 31 and 32 must carry during short-circuiting, i.e. when they are connected to conductors 22 and 21 of jumper system 20. More important is the point at which conductors 21 and 22 contact terminals 32 of cell A and 31 of cell C, respectively. It is most desirable that arm 21 contact terminal 32 of cell A at some point in the middle third of cell terminal 32 in order that, at most, cell terminal 32 would have to carry about two-thirds of the total current of cell A. More preferably, the conductor 21 would contact terminal 32 at the center point of terminal 32 so that terminal 32 would at most only have to carry one-half of the total current through cell A. Lever lugs 33*a*, 33*b*, 33*c*, would be located even with the longitudinal center of terminals 31,32 so as to press conductors 21 and 22 into contact with that center point. Even more preferable, conductor 21 would be of sufficient length so that the current load required to be carried by any portion of cell terminal 32 would be less than one-quarter of the total cell current through cell A, or more preferable less than one-tenth. In fact, one optimum length of contact would be for conductor arm 21 to contact the entire length (see FIG. 3) of cell terminal 32 as is preferably the case for the arms 21 and 22 of FIG. 12 below so that cell terminal 32 would not have to carry any excess current whatsoever during short-circuiting. The same thing applies to the relationship between conductor 22 and cell terminal 31 of cell C. If these relationships are maintained, as desired, then the amount of material which must be provided in cell terminals 31 and 32 is drastically reduced and a major cost reduction can be obtained in the overall cell plant.

In order to handle the current flowing through the junction between arms 21,22 and terminals 32 of Cell A and 31 of Cell B, respectively, is preferably at least about 2 square inches per kiloampere of current passing through the contact area. However, tha area of contact should be small enough that the contact pressure is sufficient to deform surface irregularities. If the contact area is excessive, an excessive amount of force will be necessary to deform surface irregularities.

Intercell connector 50 is shown as a bolted pair of parallel conductive plates in FIG. 2. However, other suitable intercell connectors could be utilized and other means of attaching the intercell connectors to terminals 32 and 31 could also be utilized. For example, intercell connector 50 could be hinged to either terminal 32 or 31 and be simply rotated out of engagement with the other of terminals 32 and 31. In such a case, the movable side of the intercell connector would be provided with suitable fastening means to assure a pressure contact in its normal position connecting terminals 31 and 32. It is very important that a high contact pressure be established and maintained between conductors 21, 22 and terminals 32, 31 so that surface irregularities are flattened. A contact pressure of 3,000 pounds per square inch is preferred for this purpose. A bolted connection can achieve such a pressure. As shown in FIG. 2, the intercell connector 50 can be removed by loosening bolts. The loosened connector 50 can then be slid longitudinally along terminals 32 and 31 into the aisle on the opposite side from jumper system 20. Such removal could be done by remote controlled automatic means such as a crane or a hoist, if desired. Remote control would be preferable to minimize the hazard to personnel inherent in manual operations between cells. This is especially so where, as is preferable, the spacing between cells is at a minimum. A preferable alternative intercell connector movement would be a "slide-back" type system in which recesses (see FIG. 23) are provided in either terminal 32 or 31 and the bolts of intercell connector 50 are slid laterally into such recesses this movement being toward the cell to be disconnected. Such movement could be remotely controlled by use of a hydraulic jack or a pneumatic jack with appropriate remote operation. Such a remote operated hydraulic jack would be preferably inserted into spaces 25 and 26 from the side of the series of cells opposite jumper system 20 or the hydraulic jack could be designed to fit around the arms of jumper system 20.

Yet another alternative would be to have only a single pair of conductors 21 and 22 to connect each pair of terminals 31 and 32, rather than having a double pair of conductors 21 and 22 for each pair of terminals 31 and 32. This change would require that the single pair of conductors 21 and 22 be of much more substantial dimension and preferably a backup plate (see plate 21*d* of FIG. 7) would be placed on the opposite side of terminals 31 and 32 from the remaining single pair of conductors 21 and 22 in order that pressurized contact could be maintained by squeezing terminals 32 and 31 between conductors 21 and 22 and the back up plates, 21*d* respectively without damage to terminals 31,32. The use of a back up plate 21*d* or "stiffener plate" (see FIG. 7) could reduce the amount of expensive conductive material necessary and further to provide an added amount of rigidity to the conductor-terminal couple when engaged.

Figure 4:
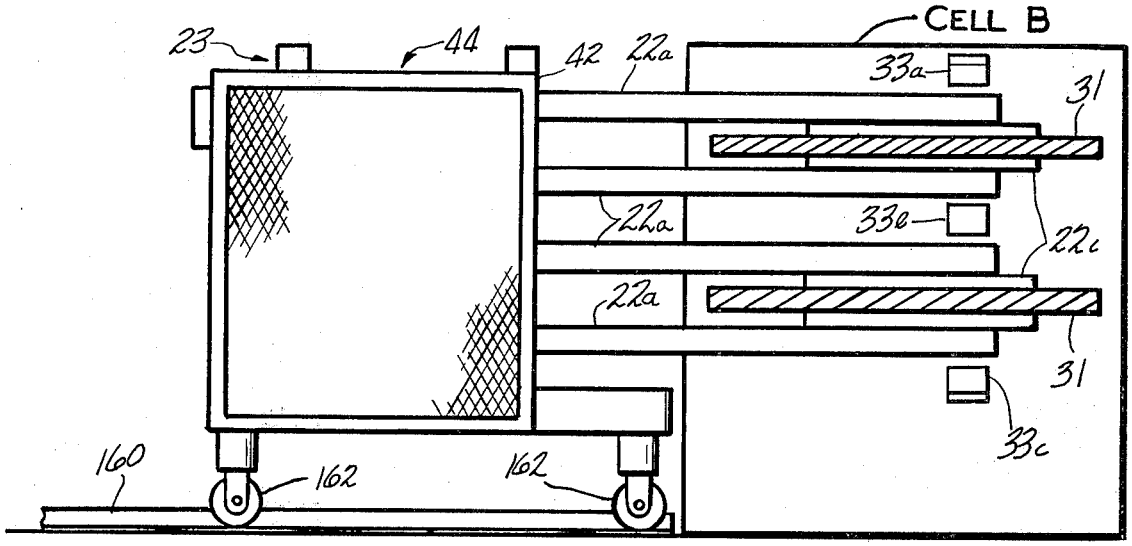
FIG. 4 is an elevational, cross-section taken along line 4—4 of FIG. 2 but showing a portion of the jumper system enclosed in a housing.
Figure 5:
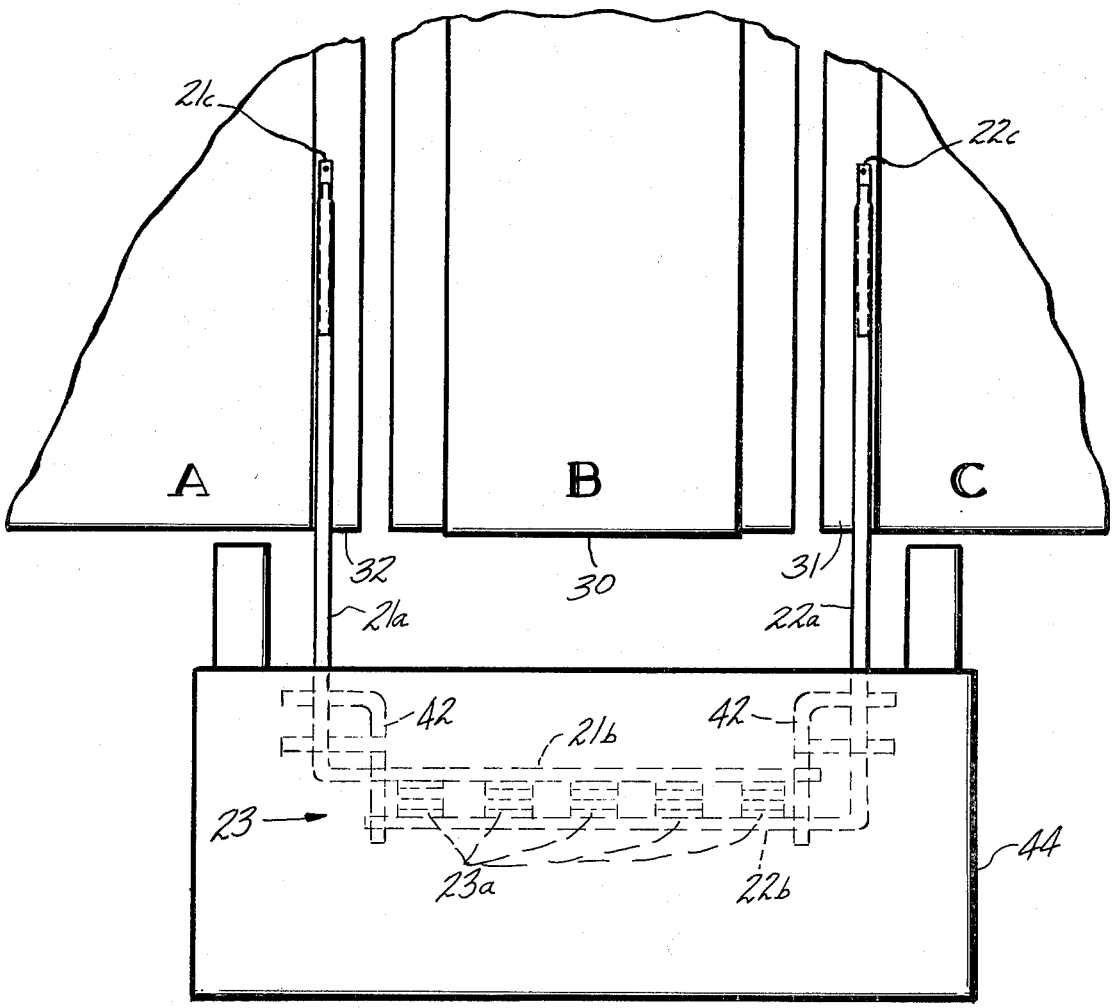
FIG. 5 is a top, exploded, plan view of the attachment of jumper system of FIG. 4 to the cell terminals.

Switching device 23 includes a number of commercially available switch units 23*a*, preferably vacuum switches such as Westinghouse Basic Modules model WX-23823 which are gang connected to a pneumatically operated mechanism. The L-shaped conductors 21 and 22 are held in an insulated rack 42 shown in FIGS. 4 and 5. Referring to FIGS. 4 and 5, the long arm 21*a* of each conductor 21 and the long arm 22*a* of each conductor 22 are provided with a contact pad 21*c* and 22*c*, respectively. Contact pads 21*c* and 22*c* are preferably replaceable in order that they may be replaced if they are damaged by the high-current load during use so that there is no necessity to replace long arm 21*a* and 22*a*. Pads 21*c* and 22*c* could include silver contacts, preferably replaceable, to minimize such damage. The short arm 21*b* and 22*b* (see FIG. 7) of conductors 21 and 22 are each joined mechanically by insulating holders within rack 42 (see FIG. 5) and are connected or disconnected electrically by the unit switches. The horizontal pairs of "L-shaped" conductors 21 and 22 cooperate with a like set of conductors 21 and 22 in a lower vertical plane. The two vertical pairs of conductors hinged together with a slight amount of variable space to form "alligator" jaws to grip the long thin horizontal terminals 31 and 32 of the respective cells A and C to be shorted. Pads 21*c* and 22*c* (see FIGS. 4–5) are preferably long enough to reach between cells to make contact with the cell terminals 31 and 32 over a length within the range of from about 25% to about 100% of the length of terminals 31 and 32. Lever lugs 33*a*, 33*b*, 33*c*, (shown in FIGS. 1, 2, and 4 only) can be attached to cell C to help maintain the right or "outer" end (FIG. 3) of arms 21*a* in contact with terminal 32 of cell C during movement of arms 21*a* from a position spaced from terminal 32 toward each other into the position shown in FIG. 3. While conductor pads 21*c* and 22*c* are preferable, it will be understood that system 20 is operational even if pads 21*c* and 22*c* are omitted so that terminals 31 and 32 are contacted directly by long arms 21*a* and 22*a*. Also, it will be appreciated that there may be more than one contact pad 21*c* or 22*c* for each long arm 21*a* or 22*a* are conversely there may be more than one long arm 21*a* or 22*a* for each contact pad 21*c* or 22*c*.

Figure 7:
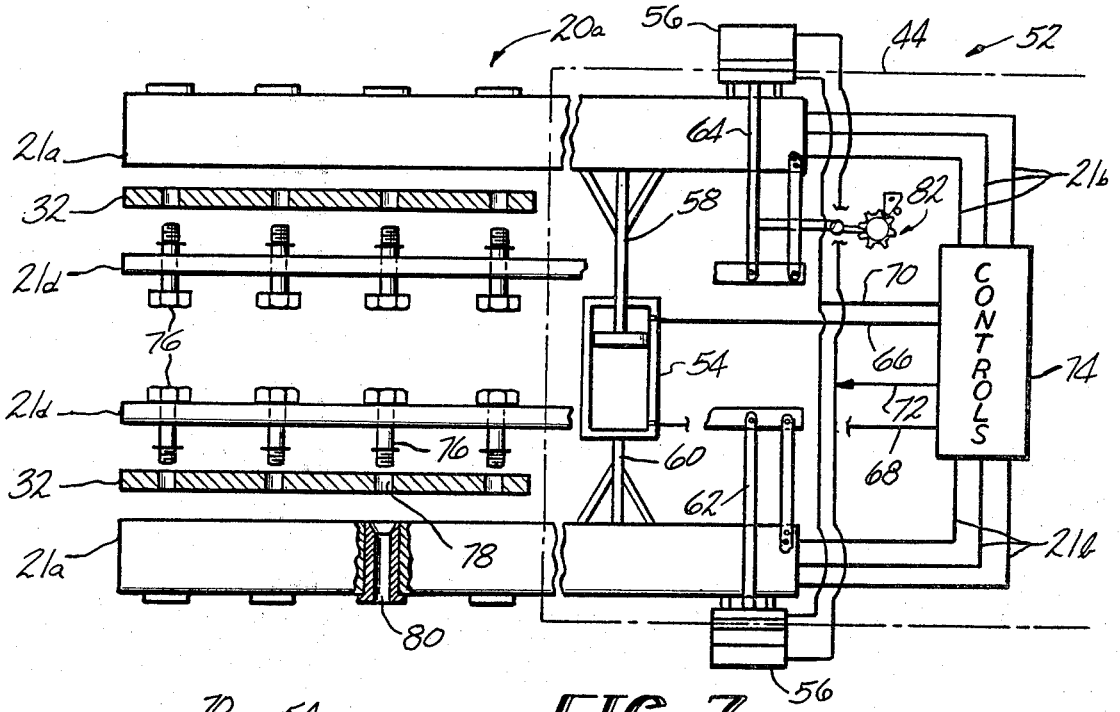
FIG. 7 is a side, elevational schematic view of a preferred remotely controlled pneumatic system for engaging the jumper system of FIGS. 4 and 5.

FIG. 7 shows in greater detail how long arms 21*a* and 22*a* can be much taller than wide in order to fit between the cells yet carry the high current.

Figure 3:
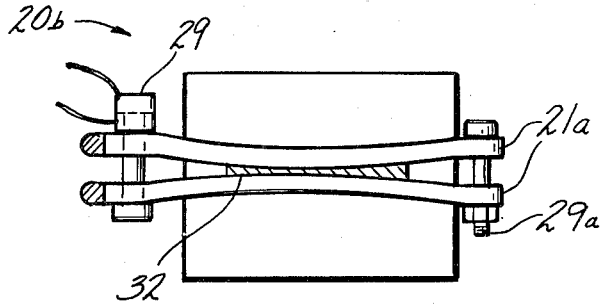
FIG. 3 is an elevational, cross-sectional view taken along lines 3—3 of FIG. 1 but showing a modified jumper system for use in the method of the invention instead of the jumper system of FIG. 1.

FIG. 3 shows an alternate clamping system 20*b* for system 20 of FIG. 1 and system 20*a* of FIG. 7 (described below). The system 20*b* of FIG. 3 has a second lower conductor arm 21*a* which is held to the upper conductor arm 21*a* at its outer end by a hinge bolt 29*a* and is moved toward or away from the upper arm 21*a* by a hydraulic cylinder 29. For cell A-D designed for total current capacity of 150KA, hydraulic cylinder 29 would preferably have sufficient force to generate a 3,000 psi contact pressure (i.e. 20 psi/KA) between arms 21*a* and terminal 32 to flatten surface irregularities and achieve better conductivity therebetween.

Figure 6:
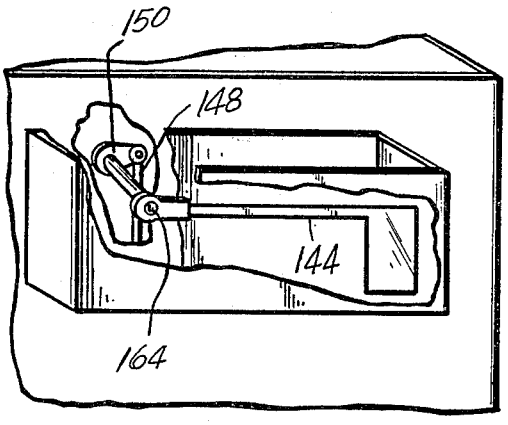
FIG. 6 is a perspective, cut-away view of a signal means which can be used with the system of FIGS. 1–5 in order to indicate electrical engagement of the system.

FIG. 6 will be discussed later below.

Figure 14:
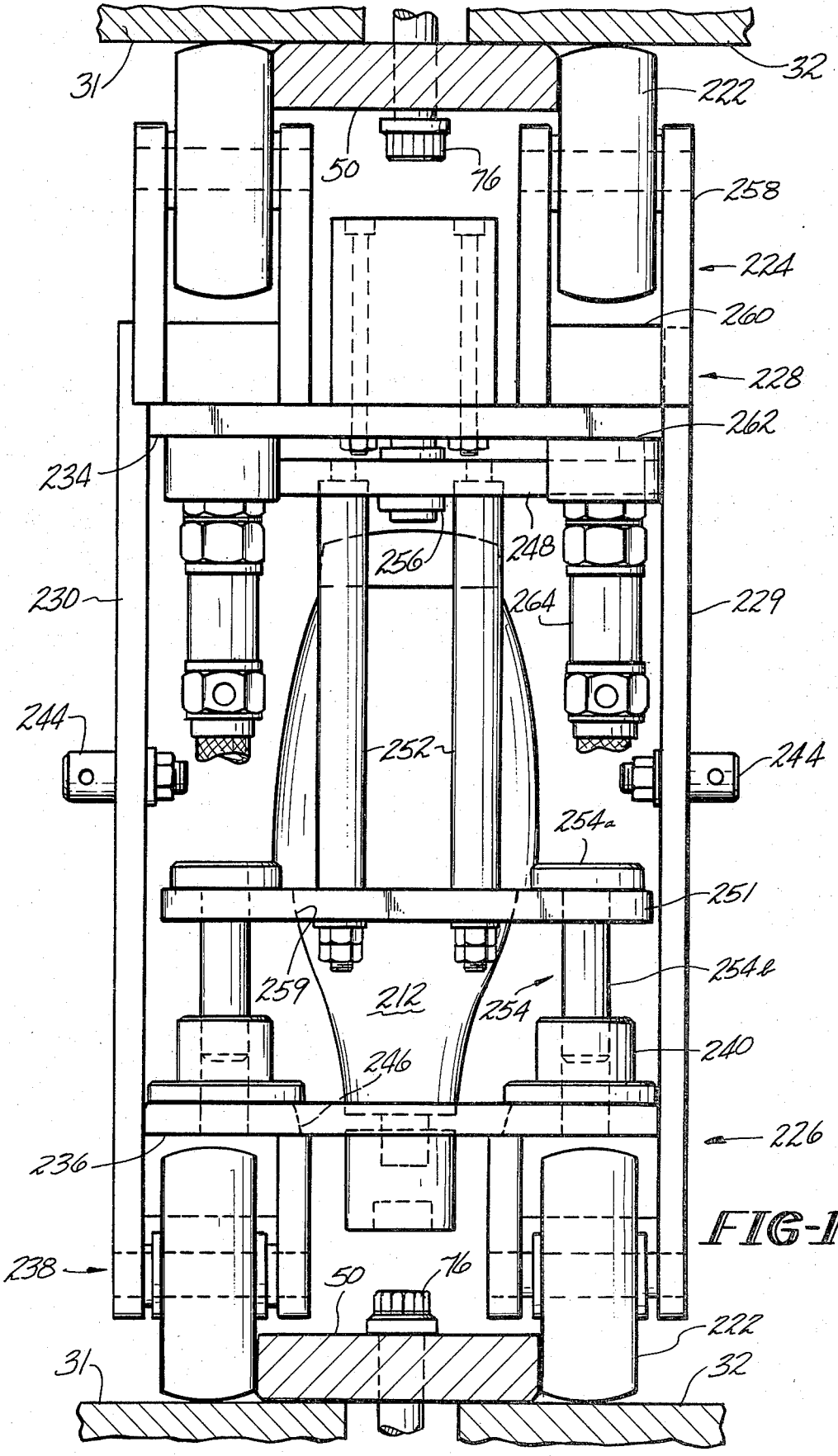
FIG. 14 is a front-elevational view of the intercell portion of FIG. 13 in operable position between two electrolytic cells.

FIG. 7 shows a schematic, side elevational view of a remotely controlled pneumatic system for engaging a modified jumper system 20*a*. The pneumatic controls would preferably be mounted within a box-like structure 44, (see FIGS. 4 and 5) which contains the rack 42 for holding the conductors 21 and 22 and which also contains switch mechanism 23. The remotely controlled pneumatic system 52 of FIG. 7 and FIG. 8 includes one piston and cylinder assembly 54 and two piston and cylinder assemblies 56, four connecting links 58, 60, 62, and 64, four pneumatic supply lines 66, 68, 70, and 72, and a control section 74. The jumper system 20*a* of FIG. 7 is different from that of FIGS. 1–5 in that instead of having two pairs of conductor arms 21*a* lying on opposite sides of terminals 32, jumper system 20*a* has, instead of the center two conductors 21*a*, two stiffener plates 21*d* lying on opposite sides of terminals 32 from the outer top most and bottom most conductor arms 21*a*. Stiffener plate 21*d* serves to hold a plurality of captive bolts 76 which can be inserted through openings 78 in terminals 32 and tightened into threaded sleeves 80 of arms 21*a* in order to exert a large contact pressure between arms 21*a* and terminals 32, for reasons noted above. Captive bolts 76 and threaded sleeves 80 and openings 78 can be better understood by reference to FIG. 12 below. When it is desired to engage arms 21*a* with terminals 32 fluid is fed to assembly 54 through supply lines 66 and removed from cylinder 54 through line 68 thus contracting piston and cylinder assembly 54 and pulling links 58 and 60 inwardly toward assembly 54. Conversely, when it is desired to disengage arms 21*a* from terminals 32 fluid is supplied through line 68 to assembly 54 and removed from assembly 54 through line 66 so as to expand assembly 54 and push links 58 and 60 outwardly. Similarly, when it is desired to engage stiffener plates 21*d* and captive bolts 76 with arms 21*a*, fluid is supplied to piston and cylinder assemblies 56 through lines 70 and withdrawn from assemblies 56 through lines 72 so as to contract assemblies 56 to move links 62 and 64 outwardly. Once in this position, captive bolts 76 are tightened into threaded sleeves 80 by a remotely operated bolt tightener such as shown in FIG. 14 and described below. When it is desired to disengage captive bolts 76 and stiffener plate 21*d* from terminals 32 and conductor arms 21*a*, captive bolts 76 are loosened by the bolt rotator and then fluid would be supplied through lines 72 to assemblies 56 and withdrawn from assemblies 56 through lines 70 so as to expand assemblies 56 and pull length 62 and 64 inwardly toward assembly 56.

Also shown in FIG. 7 is a rachet-type counter 82 for counting the number of times arms 21*a* are moved into contact with terminals 32. This optional counter 32 serves to give an indication of the number of operations so that preventive maintenance procedures can be taken when a certain number of operations have occurred.

Figure 8:
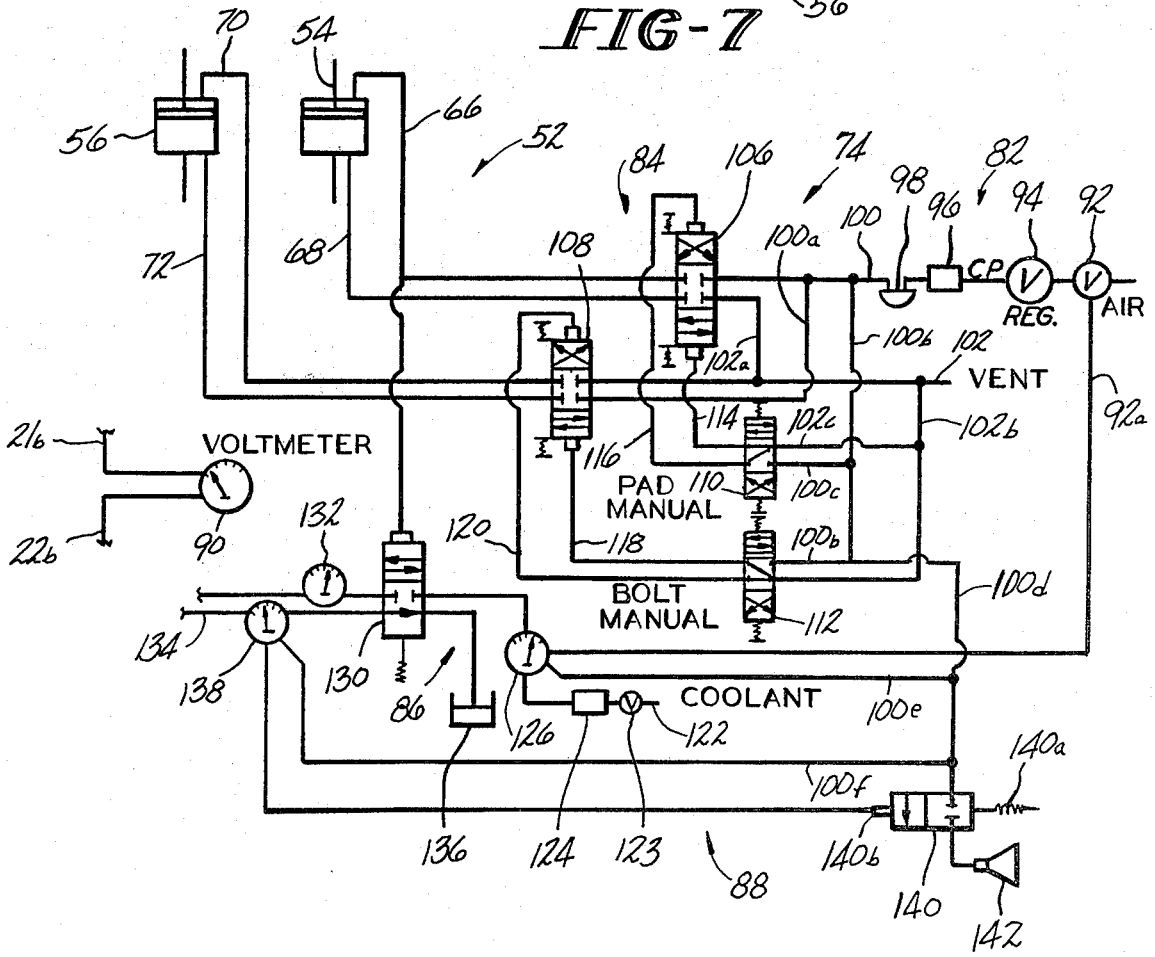
FIG. 8 is a schematic view of a preferred pneumatic control system which allows the remote control of the jumper system of the invention.

FIG. 8 shows a schematic diagram of pneumatic control section 74 of jumper system 20*a* of FIG. 7. Pneumatic control section 74 allows remote operation of the jumper system 20*a*. Section 74 is detailed to show a typical pneumatic circuit for remote control. Other pneumatic systems could be utilized effectively as control section 74. Section 74 could even be replaced by a hydraulic or electrical section, if desired. Control section 74 includes air supply circuit 82, control valve section 84, coolant section 86 and alarm section 88. It is also very desirable that a voltmeter 90 be included to measure the voltage between conductor 21*b* and 22*b* in order to determine the voltage drop through the jumper system. Air supply circuit 82 includes a control valve 92, a regulator valve 94, a filter 96, and an oiler 98, all conventional. Control valve 92 is also provided with a tap line 92*a* which leads to coolant section 86, for reasons below described. Air supply 82 also includes a flow line 100 leading to control valve section 84 and through line 100*d*, alarm section 88, for reasons below described.

Control valve section 84 includes a main pad control valve 106 and a main bolt control valve 108 and pressurized air supply lines 100 and 100*a* and vent lines 102 and 102*a*. Control valve section 84 can preferably also include an auxiliary pad control valve 110 and an auxiliary bolt control valve 112 and pressurized air supply lines 100*b* and 100*c* and vent lines 102*b* and 102*c* associated therewith. Main control valves 106 and 108 are three positioned, four-way, normally closed flow control valves of conventional design. They are movable from their normal position preventing flow between pressurized air line 100 and vent line 102 through piston assemblies 54 and 56, respectively. Valve 106 is normally in the position indicated in FIG. 8, in which position there is no fluid communication between lines 100, 102(*a*) and lines 66, 68. Valve 106 can be moved downwardly to allow communication between line 100 and line 68 and between lines 102(*a*) and 66 thus causing assembly 54 to expand. Alternately, valve 106 can be moved upwardly to allow communication between line 100 and line 66 and between lines 68 and 102(*a*), whereby assembly 54 will contract. Similarly, valve 108 normally prevents fluid communication between lines 102, 100(*a*) and lines 70,72. Valve 108 can be moved upwardly to allow communication between line 100(*a*) and line 72 and between line 70 and line 102, whereby each assembly 56 is expanded. Alternately, valve 108 can be moved downwardly whereby line 100(*a*) is connected to line 70 and 72 is connected to line 102, whereby each assembly 56 is contracted. In many cases it would be sufficient that valves 106 and 108 be simply manually controlled valves. However, from a safety standpoint, it may be desirable to actually control the opening and closing from a more remote location and in such case it may be desirable to add an additional pair of auxiliary control valves 110 and 112 and make control valves 106 and 108 be operated by such auxiliary control valves as seen in FIG. 8. Auxiliary control valve 110 is connected to the bottom of main pad control valve 106 by line 114 and is connected to the top of valve 106 by line 116. Auxiliary valve 110 is also connected to lines 110(*c*) which supplies pressurized air and by line 102(*c*) to vent. Valve 110 is a conventional, manually-operated, three positioned, four-way, pneumatic valve. In its normal position, valve 110 prevents fluid communications between lines 100(*c*) and lines 114, 116, but connects lines 114, 116 to vent line 102(*c*). Valve 110 can be moved upwardly to allow pressurized air to flow from line 100(*c*) into line 114 and venting the top of valve 106 through line 116 to line 102*c* so as to move valve 106 upwardly, thereby closing "jaws" or conductor arms 21(*a*). Valve 110 can conversely be moved down to connect line 100(*c*) with line 116 and connect line 102(*c*) with line 114 so as to provide pressurized air to the top of valve 106 and vent the bottom of valve 106 thereby moving valve 106 downwardly and opening or uncontacting arms 21(*a*). Valve 110 is preferably provided with springs at its oppposite ends so that when manual pressure is released from valve 110 it will assume its "vented" center position. When it is said that the center position of valve 110 is "vented" what is actually meant is that lines 114 and 116 are connected to vent line 102(*c*) and pressurized air supply line 100(*c*) is closed so that pressure is removed from both the top and bottom valve 106 so that valve 106 can assume its normally closed position. Valve 106 could be provided with springs at its upper and lower end for this purpose. In this way, the pneumatic system will hold its position long enough for captive bolt 76 to be tightened into threaded sleeve 80. Once bolt 76 and sleeve 80 are interconnected it becomes irrelevent whether or not any slow leaks in the pneumatic system exist since bolt 76 and sleeve 80 can maintain the desired contact pressure between conductor arms 21(*a*) and terminals 32.

Similarly, valve 112 can be moved up to connect line 100(*b*) with line 120 and line 118 with line 102(*b*) so as to pressure the top of valve 108 and move valve 108 down to contract assembly 56 and thus insert bolt 76. Alternately, valve 112 can be moved down to connect line 100(*b*) with line 118 and line 120 with line 102(*b*) to pressurize the bottom of valve 108 and move valve 108 up thereby expanding assembly 56 and removing or withdrawing bolt 76 if the bolt 76 is loosened from nut 80. Valve 112 would not be moved upwardly if bolt 76 were threaded as any attempt to expand assembly 56 when bolts 76 were engaged with threaded sleeve 80 might damage stiffener plate 21(*d*) or some other part of the apparatus. Like valve 110, valve 112 would preferably be provided with springs at its upper and lower end to bias it towards its center position in which line 118 and 120 were connected to vent line 102(*b*) so as to remove pressure from the top and bottom of valve 108 and allow valve 108 to assume its center position. Valve 108 would therefore preferably be provided with springs at its upper and lower end to bias valve 108 towards its "vented" center position.

Coolant system 86 includes coolant supply line 122, control valve 123, coolant filter 124, first pressure responsive valve 126, a two-positioned four-way pressure responsive shut-off valve 130, a pressure guage 132, a return line 134 and a coolant reservoir 136. When valve 123 is open, line 122 continuously provides pressurized coolants through coolant filter 124 to pressure responsive valve 126. If valve 126 senses that there is less than some preset pressure difference between line 100(*e*) and line 92(*a*) valve 126 will open to allow coolant to flow to valve 130. Valve 126 thereby serves to allow coolant to flow to valve 130 only when valve 92 is open, that is, when line 100 is pressurized. Valve 130 is normally closed but opens when line 66 is pressurized since line 66 is connected to the top of valve 130 and shoves it downwardly against a spring bias when pressurized. If line 66 is not pressurized, valve 130 nevertheless allows flow from line 134 into reservoir 136 so that coolant may be drained from the system when the system 20(*a*) is not in operation. Gauge 132 serves to measure the coolant pressure which is fed to arms 21(*a*) or other parts of system 20(*a*) as desired to prevent overheating due to the large amount of current passing through system 28 during short-circuiting operation. Line 134 receives the hot coolant from system 20(*a*) and drains that hot coolant into reservior 136.

Alarm circuit 88 includes temperature sensor 138, pressure supply line 100(*f*), pressure supply line 100(*d*) alarm valve 140, and alarm 142. Pressure supply line 100(*d*) is connected through valve 140 to alarm 142. However, valve 140 is normally closed in response to the bias of a spring 140(*a*). Valve 140 can be open to connect pressure line 100(*f*) to alarm 142 upon valve 138 sensing excessive coolant temperature in line 134 of coolant system 86. For this purpose, line 100(*d*) is in constant fluid communication with line 100(*f*) leading to the side of valve 140 opposite spring 140(*a*). Valve 138 is placed in line 100(*f*) and line 134 so that valve 138 can sense temperature in line 134 and control the flow in line 100(*f*) in response to that temperature. If valve 138 senses too high a coolant temperature in line 134, valve 138 opens allowing pressurized air to flow through line 100(*f*) to the end 140(*b*) of valve 140 opposite spring 140(*a*) to thereby move valve 140 to the right and connect line 100(*d*) with alarm 142 to sound alarm 142. Alarm 142 can be a conventional air horn or other pneumatically actuated alarm device.

FIG. 6 shows a linkage-operated pivotal flag which can be used to indicate visually that arms 21(*a*) are engaged. Flag 144 is connected to a shaft 146, which is in turn connected to a link 148 through a pivot arm 150. When arms 21(*a*) are engaged link 148 is moved upwardly against pivot arm 150 thereby rotating shaft 146 and moving flag 144 counter-clockwise into the up position. Other indicators could be used instead.

Figure 9:
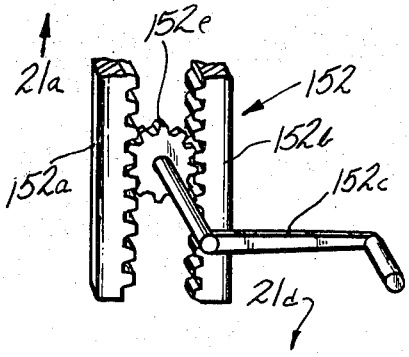
FIG. 9 is a perspective view of a rack and pinion manual crank which can be used to operate the system of FIGS. 1–8 in case of power failure.

FIG. 9 shows a rack and pinion system 152 which could be incorporated into system 20(*a*) in order to allow manual operation of arms 21(*a*) and plates 21(*d*). For example, a first rack 152(*a*) could be attached to upper arm 21(*a*) and a second rack 152(*b*) could be attached to lower arm 21(*a*). A crank 152(*c*) could then be turned clockwise to rotate a pinion 152(*e*) so as to open or disengage arms 21(*a*). Alternately, crank 152(*c*) could be rotated counter-clockwise so as to engage arms 21(*a*). A similar crank 152(*c*) could be attached to plates 21(*d*) so as to engage and disengage bolts 76.

Figure 10:
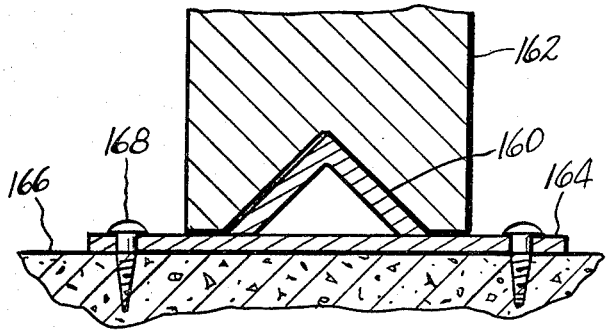
FIG. 10 is a vertical cross-section through a wheel and track device which can be used to help position the jumper systems of FIGS. 1–8.

FIG. 10 shows a positioning rail 160 which could be utilized in conjunction with wheels 162 (see also FIG. 4) to guide jumper system 20(*a*) into position. Rails 160 would be aligned in the aisle adjacent cell series A, B, C, and D at appropriate locations so that conductor 21 and 22 would be properly positioned when inserted between the appropriate cells for disconnecting operation. Rail 160 should be welded to a floor plate 164 which would in turn be attached to the floor 166 of the cell plant by lag bolts 168 or other suitable means so that rail 160 would be firmly positioned with wheels 160 thereon. Rail 160 is shown oriented across the aisle to guide the arms of the conductors into position by moving system 20(*a*) toward cells A, B, C, D. A dolly (not shown) could also be used for moving the system 20*a*) along the aisle.

Figure 11:
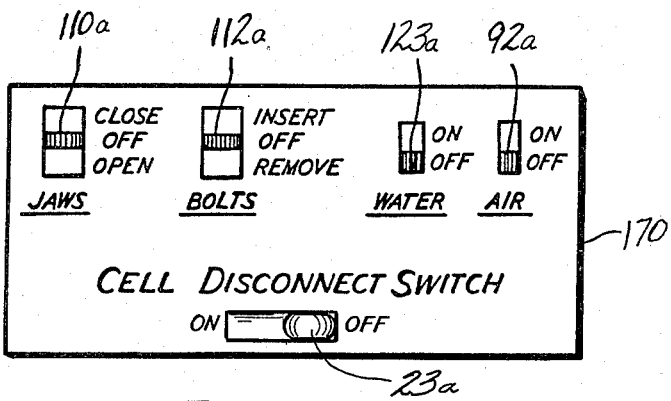
FIG. 11 is a front view of a control panel which can be used in connection with the jumper system of FIGS. 1–8.

FIG. 11 shows a control panel which could be utilized in conjunction with the control section 74 shown in FIGS. 7 and 8. In particular, this control panel 170 includes five switches 110(*a*), 112(*a*), 123(*a*), 23(*a*) and 92(*a*) for controlling operation of arms 21(*a*), plates 21(*b*), valves 123, switch means 23 and valve 92, respectively. Switches 110(*a*), 112(*a*), 123(*a*) and 92(*a*) are moved in order to move valves 110, 112, 123, and 92, respectively. For example, switches 110(*a*) can be moved up to move valves 110 up and in turn close the "jaws" or conductor arms 21(*a*). Alternately, switch 110(*a*) can be pushed down in order to move valve 110 down and thereby open conductor arms 21(*a*). Switches 112(*a*), 123(*a*) and 92(*a*) can be moved in order to move their associated valves in similar fashion. Switch 23(*a*) operates switch means 23.

Figure 12:
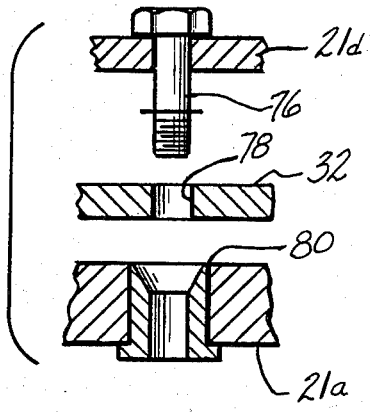
FIG. 12 is an exploded vertical cross-sectional view of a captive bolt and force-fit thread sleeve which can be used with the jumper system of FIG. 7.

FIG. 12 is an exploded view of bolts 76, opening 78, and threaded sleeve 80 which were previously shown in FIG. 7. FIG. 12 is provided so that the relationship between these parts can be better understood. The first step in engaging system 20(*a*) with terminal 32 is to move conductor arm 21(*a*) into contact with terminal 32 as above described. Next, stiffener plates 21(*d*) are moved into contact with the opposite side of terminal 32 thereby shoving bolt 76 through openings 78 in terminal 32 and into threaded sleeve 80 of conductor arms 21(*a*). At this point, although bolts 76 are inserted into threaded sleeve 80, bolts 76 are not threadably engaged or locked into sleeves 80. An additional operation is necessary at this point. Some suitable rotational means is placed on the head of each bolt 76 and bolts 76 are rotated into engagement with the threads of sleeve 80. This rotation continues until a desired contact pressure is reached between conductor arms 21*a* and terminal 32. A torque wrench or other torque-limited rotation means is desirable for this purpose so that bolts 76 are not overtightened. Similarly, when it is desired to loosen bolts 76, a suitable rotator is attached again to the head of bolt 76 and bolt 76 is loosened from threads of sleeve 80. After bolts 76 are so loosened, plate 21*d* is moved away from terminal 32 and then conductor arm 21*a* can be moved away from terminal 32 thereby disengaging jumper system 20*a* from terminal 32.

FIG. 13 is a vertical elevational view showing the active "dolly" portion 210 of an apparatus for loosening and tightening electrical connector 50 between electrolytic cells A-B and B-C. FIG. 13 shows portion 210 positioned between the two cell terminals 32. Portion 210 is used to tighten and loosen bolts 76. Bolts 76 of FIG. 13 are preferably the same as bolts 76 of FIGS. 7 and 12 and hence are given the same reference number. However, bolts 76 of FIG. 13 are on an intercell connector 50 instead of on an arm 21*a* of a jumper 20*a*. Bolts 76 of FIG. 13 serve to press an intercell connector 50 into electrical contact with both terminals 32 and another terminal 31 (see FIGS. 1–5). Portion 210 includes a remotely operable tightener means for selectively tightening and loosening the electrical connector 50. One suitable tightener means is an impact wrench 212. It will be understood that bolts 76 could be replaced by conventional screws, Phillips screws, Allen screws or some other type of fastener and that impact wrench 212 would be either modified or replaced by some tightener means suitable for tightening and loosening such fastener means. However, for purposes of illustration, the remainder of the specification will be written on the assumption that a socket-type pneumatic impact wrench is to be utilized as the tightener means.

Portion 210 comprises impact wrench 212, a moveable support means 214 for supporting the impact wrench 212 and a locator means 216 for locating wrench 212 at the proper position with respect to bolt 76.

Impact wrench 212 can be a Chicago Pneumatic model No. CP-0606-TESAB $\frac{3}{4}$ inch capacity, 130–400 foot pound pneumatic impact wrench weighing approximately 3 pounds or any other suitable pneumatic impact wrench. Impact wrench 212 is connected by a pneumatic line 218 to some supply of pressurized air through control means 304 (see FIG. 19).

Support means 214 comprises a framework 220 and eight wheels 222. Framework 220 includes a fixed section 224 and a moveable section 226. Fixed section 224 is attached to lower wheels 222 directly and to upper wheels 222 indirectly through a wheel adjustment assembly 228. Section 224 comprises two vertical side plates 229 and 230 (see FIG. 14) an upper horizontal cross plate 234, a lower horizontal cross plate 236, four lower wheel supports 238, four guide sleeves 240, and a wrench lifting assembly 242. One suitable assembly 242 would include an aluminum "Fabco" pancake cylinder with a 3" bore and a $1\frac{1}{2}$" stroke. Wrench lifting assembly 242 serves to raise and lower moveable sections 226 so as to raise and lower impact wrench 212 out of and into engagement with bolt 76. Side plates 229 and 230 each include a lug 244 so that portion 210 can be supported by lug 244 and rotated 180° in order to tighten or loosen upper bolts 76 instead of lower bolts 76.

FIG. 14 is a front elevational view of the portion 210 of FIG. 13 and portion 219 can best be understood by reference to both FIG. 13 and FIG. 14. Fixed section 224 of framework 220 resembles a box with an open front and back and four wheels 222 on the top of the box and four wheels 222 on the bottom of the box. The vertical sides of this box are formed by side plates 230 and 231 while the top and bottom of the box are formed by upper cross plate 234 and lower cross plate 236, respectively. Within this box framework 220 carries moveable section 226. Moveable section 226 supports impact wrench 212 in such a position that its operative lower end projects downwardly through an opening 246 in lower cross plate 236. Framework 220 also serves to support locator means 216 (see FIG. 13 and FIG. 15). In particular, locator means 216 is mounted on lower cross plate 236 and projects downwardly below cross plate and between lower wheel supports as described below. Other support frameworks could be utilized in place of framework 220 so long as wheels or other movement-allowing guide means were provided for guiding framework 220 in a path along intercell connector 50 so that wrench 212 could be placed in operative position.

Moveable section 226 of framework 220 comprises an upper moveable plate 248 and a lower moveable plate 251, four vertical posts 252, four guide pins 254, and a piston fastener means 256. Assembly 242 of fixed section 224 is mounted atop upper cross plate 234 of framework 220 with the piston of assembly 242 projecting downwardly through cross plate 234 and into engagement with fastener 256. Fastener 256 in turn connects the piston assembly 242 to upper plate 248. Upper plate 248 is connected to lower moveable plate 251 by posts 252. Posts 252 can be bolted or otherwise connected to plate 248 and plate 251 for this purpose. Plate 251 is a rectangular plate with an opening 259 (see FIG. 2) which conforms to the outer surface of impact wrench 212 and allows impact wrench 212 to be positioned vertically with its socket 212*a* projecting vertically downward through opening 259 as well as opening 246 so that socket 212*a* can be moved into engagement with bolt 76. Guide pins 254 are vertical cylinders with a disc-shaped head. Pins 254 pass downwardly through openings in lower moveable plate 251 and pass downwardly into guide sleeves 240. Thus, moveable section 226 is limited to vertical movement so that section 226 will not rotate when bolts 76 are tightened or loosened. Pins 254 are provided with a disc-shaped head 254*a* and a lower cylindrical portion 254*b*. The lower cylindrical portion 254*b* of pins 254 conforms to the bore of guide sleeves 240. Heads 254*a* can be welded or otherwise connected to plate 251 so that pins 254 are prevented from moving upwardly out of guide sleeves 240. Moveable section 226 thus is vertically moveable within fixed section 224 in response to the application or removal of pressure from assembly 242.

Wheel adjustment assemblies 228, which are attached to upper cross plate 234, each comprise a wheel 222, a pair of vertical wheel support plates 258, a moveable wheel support block 260, a fixed wheel support block 262, a "push" operated air cylinder 264 with a vertical piston shaft 265 and a pair of guide cylinders 266. One piston and cylinder assembly suitable for assembly 264 is a Schrader brass air cylinder with a 1" bore and 1" stroke, push operated. Wheels 222 are rotably supported on an axle 268 which is connected to two spaced wheel support plates 258. Wheel support plates 258 are in turn attached by a pair of set screws 270 or other fastener means to moveable block 260. Guide cylinders 266 pass vertically from moveable block 260 and into stationary block 262 to make a "floating" connection between blocks 260 and 262. Guide cylinders 266 are pinned by a pin 272 to moveable block 260 but are free to move vertically relative to fixed block 262 so that block 260 is able to move vertically relative to block 262. Block 260 includes boss, 260*a* adapted 262. Block 260, a shaft-receiving boss, 260*a* adapted to receive the force of piston shaft 265 when pressurized air is supplied to cylinder 264. An air pressure is supplied to cylinder 264, shaft 265 is caused to move vertically upward relative to cylinder 264 whereby shaft 265 contacts boss 260*a* and forces boss 260*a* in block 260 vertically upward. This upward movement in block 260 moves wheels 222 upwardly until it contacts some immoveable object such as cell terminal 32. The force on shaft 265 is thus transferred to wheels 222 and is the pressure which holds upper wheels 222 against the bottom side of upper cell terminal 32. If portion 210 were inverted, as above described, so the impact wrench 212 pointed upwardly instead of downwardly, wheel support assembly 228 would then be located at the bottom of portion 210 and would cause cross plate 234 to move upwardly lifting the remainder of portion 210 except for block 260, plates 258, axles 268, and the wheels 222 attached to plates 258. Such movement of the remainder of portion 210 would be in the upward direction. Therefore, it would be expected that pressure would be maintained on air cylinder 264 during the entire time that portion 210 was between cell terminals 222. Wheel adjustment means 228 thus serves to expand or contract portion 210 vertically in order that it can fit snugly between two spaced terminals 32. This is especially important when portion 210 is inverted, as otherwise impact wrench 212 might not be able to engage upper bolts 76.

FIGS. 13 and 15–17 show particular detail of locater means 216, which serves to locate bolt 76 and stop portion 210 during its travel along the length of electrical connector 50 at a predetermined location such that impact wrench 212 is correctly aligned with one of bolts 76. This predetermined position is a position where impact wrench 212 is directly over such bolt 76 so that when wrench lifting assembly 242 is expanded, socket 212*a* of impact wrench 212 will be moved downwardly over the top of bolt 276 so that then impact wrench 212 is activated to apply torque to socket 212*a*, socket 212*a* will apply torque to bolts 76. Without such a bolt locater, it might be quite difficult to remotely operate portion 210 in such a fashion as to stop portion 210 at such a predetermined position. While the locater means described is the preferred one, it will be appreciated that those skilled in the art may make structural modifications to the locater means 216 without departing from the scope of the invention so long as some means is provided for locating bolts 76. Locater means 216 is a preferred feature of the device but the device could be operated albuit more cumbersomely, with a manual locater means (e.g. marks on a pushing stick, etc.). Nevertheless, the remainder of the specification will be described on the assumption that the optional locater means 216 is provided. Locater means 216 comprises a horizontal notched stop plate 274 (see FIGS. 13, 15 and 17), a linkage 275, and a pneumatic, double-acting cylinder and piston assembly 277. One suitable assembly 277 is a double-acting Schrader air cylinder with a 1" bore and a 1" stroke. Plate 274 cannot slide indefinitely along the upper surface of electrical connector 250 because bolts 76 project upwardly from such surface and plate 274 will contact bolts 76 and stop portion 210 from further movement. Linkage 275 and assembly 277 cooperate to position plate 274 in the proper position to be stopped by bolts 76. After portion 210 is stopped, assembly 242 is activated to move socket 212*a* onto the bolt 76 and wrench 212 is activated to either loosen or tighten bolt 276 as desired. Once the desired loosening or tightening operation is completed, cylinder 277 is expanded so as to cause linkage 275 to lift plate 274 above the tops of bolts 76. Now portion 210 is free to roll beyond bolt 76 and continue its travel along electrical connector 250. As soon as portion 210 move sufficiently forward to clear bolt 76, assembly 277 is contracted to relower plate 274 against the upper surface of electrical connector 250 so that plate 274 will be stopped by the next bolt 76 in the path of travel. Then, assembly 242 is again activated to lower wrench 212 and wrench 212 is activated to tighten or loosen the next bolt 76 and then assembly 242 is reversed to raise wrench 212 back up again. This process continues until all of the bolts along electrical connector 250 are loosened or tightened, whereby electrical connector can be engaged or disengaged from terminals 232. Linkage 275 comprises a linearly, moveable, vertical, offset-lift link 278, a pair of pin bars 279, a vertically rotatable lift lever link 280, a pair of set screws 281, a fulcrum 282, vertical link bar 283 and a piston clevis 284. Lift link 278 is offset rearwardly at its upper end and forwardly at its lower end to produce a shoulder 278*a* which limits upward movement of lift link 278. Upward movement of link 278 is stopped when shoulder 278*a* comes into contact with the lower side of lower cross-plate 236. Link 278 is also provided with a pair of horizontal slots 278*b* (see FIG. 17) which allow pin bars 279 to slide relative to link 278 so that upward movement of link 278 is not prevented by the pins 279*a* of pin bar 279. Set screws 281 rigidly attach pin bar 279 to lever link 280 so that pin bars 279 in cooperation with lever link 280 form a clevis or a yolk about the central portion of lift link 278. Lever link 280 is horizontally fulcrumed on horizontal fulcrum 282 which is attached to the lower surface of horizontal cross-plate 236, whereby lift lever link 280 is allowed to rotate in the vertical plane in response to expansion or contraction of piston and cylinder assembly 277. Lever link 280 is upwardly offset at its rear end so that it is higher than loosened bolts 76 when the rearward end of lever link 280 is lowered (i.e. when plate 274 is raised). The rearward end of lever link 280 has a clevis 280*a* which is connected to piston clevis 284 by link bar 283. Thus, when assembly 277 is expanded, the rearward end of link 280 is lowered and the forward end of link 280 is raised, thereby raising pin link 279, lift link 278, and stop plate 274. Assembly 277 is attached the lower cross-plate 236 by a bracket 288 which projects beyond the rear end of cross-plate 236 in order that assembly 277 can be above the level of cross-plate 236 so that assembly 277 does not interfere with movement of portion 210. In order to further guide the upward movement of lift link 278, a bracket 290 can be added to the bottom of cross-plate 236 adjacent the rear side of slot 286 to prevent lift link 278 from rotating within slot 286 either forwardly or rearwardly.

FIG. 18 is a top view of block 260 and wheel support plates 258 in order to show the location of guide cylinders 266 and boss 260*a*. Guides 266 are preferably placed on opposite sides of block 268 so that block 260 is guided evenly upward and downward in its vertical movements.

FIG. 19 shows a cart 292 which can be used to move the "wrench dolly" (active portion 210) along the aisle adjacent to a series of cells having terminals 31 and 32. FIG. 19 is a side view of cart 292 and from the side, cart 292 appears to have an inverted F-shape. That is, cart 292 comprises a horizontal base member 294, a vertical support member 296, a horizontal shelf member 298, a horizontal pivot arm 299, and 4 wheels 300. Wheels 300 are attached to base members 294. Support member 296 is attached to the rear of the base member 294 and projects upwardly approximately the height of the lower surface of the upper cell terminal 32 with which the active portion 210 is to be contacted. Shelf member 298 is a horizontal plate. Shelf member 298 is attached at its rearward end to vertial support member 292 and projects forwardly in a horizontal plane at the same height as the upper surface of lower cell terminal 32. Shelf member 298 would preferably be provided with an insulative, forward end 302 so that cart 292 could be abutted against the edge of cell terminal 32 in order that portion 210 could be rolled directly from shelf 298 onto terminal 32. Cart 292 would preferably be provided with an alignment device such as engagement member 303 in order that cart 292 could be properly aligned in the lateral direction so that wheels 222 of portion 210 would straddle connector 50 when portion 210 is rolled off of cart 292 and onto terminal 32. Cart 292 also carries the control panel 304 which includes the pneumatic switches for controlling the actuation of assemblies 242, 264, and 277 and to impact wrench 212 by which the loosening and tightening operations are remotely controlled. Pneumatic lines 306 run between control panels 304 and the various pneumatic wrench and piston and cylinder assemblies of portion 210. Control panel 304 would also be connected by a suitable pneumatic line 307 to a regulated source of pressurized air 308.

With the above structure in mind, it is readily apparent how the apparatus is operated. Cart 292 is moved into position between two cells to be disconnected and is aligned with cell terminals 32 and 31 in a lateral position such that wheels 222 will straddle electrical connectors 50 when portion 210 is rolled off of cart 292 and onto cell terminals 32. Portion 210, is then rolled along connector 50 until stop plate 274 strikes the first bolt 76 closest to the end of connector 50 from which portion 210 was inserted. At this point assembly 264 and 242 are activated so that portion 210 is expanded into engagement with both upper and lower cell terminals 32 and impact wrench 212 is lowered into engagement with bolt 76. Impact wrench 212 is then activated to tighten or loosen bolt 76 and then assembly 242 is again activated to raise impact wrench 212 out of operative position. Following the raising of impact wrench 212, assembly 277 is activated to raise stop plate 274 so that it clears the loosened bolt 76. Portion 210 is now moved beyond the first bolt 76 and assembly 277 is again activated to lower plate 274 against the top of connectors 50. Portion 210 is then moved forward until plate 270 strikes the next bolt 76 and assembly 242 is then again activated to relower wrench 212 into operative position. This process is repeated until all bolts of connector 50 are either loosened or tightened, as the case may be. Portion 210 is then pulled back onto cart 292 and pivots 244 are placed into pivot arm 299 and portion 210 is rotated 180° so that impact wrench 212 now faces upwardly and then the operations are again repeated for example, this time working from the far end of the upper cell connector 50 toward cart 292. When the operation is complete, portion 210 is put back onto cart 292 and wheeled to the next location to be disconnected. In this way the tightening and loosening of intercell connectors can be accomplished remotely without the need for operators to manually enter the space between the cells and manually disconnect bolts 76 and reconnect bolts 76.

While active portion 210 is shown (FIGS. 13–14) straddling connector 50, with wheels 222 on terminals 31 and 32, portion 210 could ride on flanges (not shown) attached to connector 50 or to conductor arms 21*a* or stiffener plates 21*d* (not shown). This would be desirable where connector 50 was very high, in order to reduce the size of portion 210 and hence reduce the weight of portion 210 to make portion 210 easier to manipulate.

FIGS. 20–22 show a preferred remote-controlled intercell connector bar jack 310 designed to move an intercell connector bar 50 from an engaged position to a disengaged position and vice versa. FIG. 23 shows laterally movable intercell connectors 50 for connecting cells 30 described above. The preferred jack 10 of FIGS. 20–22 is designed to move the intercell connector of FIG. 23 laterally. Other intercell connectors could be moved in other manners by other intercell connector bar jacks. Intercell connector bar jack 310 comprises two first contactor means 312 and 314, one second contactor means 316 and one pusher means 318. Pusher means 318 preferably comprises a hydraulic assembly 320, a pair of support legs 340, a leg cross member 341, (see FIG. 21) a pair of vertical cross members 334, a pair of contactor support arms 336,338, and a clevis-type piston shaft connector 328. Hydraulic assembly 320 includes cylinder 322, piston 324, piston shaft 326, two hydraulic swivel connectors 342,344, two hydraulic flow lines 343 and 345 and a control valve 347. Hydraulic connectors 342 and 344 are connected, respectively, to two hydraulic fluid lines 343 and 345, so that hydraulic fluid can be supplied to and removed from opposite sides of piston 324 with cylinder 322. Hydraulic lines 343 and 345 are also connected to a three position, four-way, normally vented control valve 347 (see FIG. 21) of conventional design which controls the direction of flow through lines 343 and 345 in order to selectively expand and contract assembly 320.

Second contactor means 316 is a rigid rectangular plate which is attached to the back of cylinder 322 and which is adapted to rest against a wall 30*a* shown on the left of FIG. 1. Second contactor means 316 and the back of cylinder 322 are supported on terminal 32 by a pair of support legs 40 which are attached at their upper ends to contactor means 316 and are connected together by a horizontal leg cross member 341 near their lower ends. In FIG. 1, contactor means 316 serves to prevent cylinder 322 from moving to the left when assembly 320 is expanded so that piston 34 moves to the right rather than cylinder 322 moving to the left. It will be apparent that assembly 320 could be readily reversed so that contactor means 316 is attached to the end of piston shaft 326 attached to piston 324 and cylinder 322 is attached to clevis connector 328, without altering the function of jack 310. However, in the embodiment shown, piston 324 is connected by piston shaft 326 to clevis connector 328. Thus, when assembly 320 expands piston shaft 326 forces clevis connector 328 to the right. Vertical cross members 334 and contactor support arms 336 and 338 are therefore also forced to the right since they are connected through a connector plate 348 to clevis connector 328. Contactors 312 and 314, arms 336 and 338, and members 334 are similarly moved to the right and contactors 312 and 314 shove intercell connector 50 to the right. The attachment of second contactor means 316 to the rear of cylinder 322 is accomplished by any suitable fastener means such as bolts 346 while the attachment of plate 348 to vertical cross members 334 is by means of any suitable fastener such as bolts 349. Upper and lower contactor support arms 336 and 338 are adjustably attached to a pair of adjusting blocks 356 (best seen in FIG. 2) which are in turn connected to horizontal cross plates 335. Horizontal cross plates 335 lie between and connect the top ends and bottom ends of vertical cross members 334. The lateral position (see FIG. 1) of arms 336 and 338 with respect to blocks 356 is determined by alignment of adjuster holes 351 in adjusting blocks 356 with adjusting holes 352 of arms 336 and 338. Blocks 356 are provided with two pairs of adjusting holes 351 so that arms 336 and 338 can be located in one of two positions depending on which pair of holes 351 are aligned with holes 352. An adjusting block pin fork 358 serves to maintain alignment of holes 351 and 352. The pins of 359 of pin fork 358 are inserted horizontally through holes 351 into holes 352 and then through another set of holes 351. The pins 359 of the lower pin fork 358 may also be inserted through pin holes 355 in member 334. The pins 359 preferably each have a hole in which a quick release snap pin 357 can be inserted in order to maintain pins 359 in holes 351 and 352 following insertion. In order to better show the two positions of arms 336 and 338, the second or "retracted" position of arm 338 is shown in FIG. 20 by phantom lines 370. It will be understood that this retracted second position is utilized when intercell connector 50 is initially in its left most position shown by phantom lines 372. From such a position, expansion of assembly 320 results in movement of intercell connector 50 from the "disengaged" position shown by phantom line toward the "engaged" position shown in solid lines in FIG. 20. Therefore, it should be understood that the position of intercell connector 50 in FIG. 20 is a middle or "engaged" position, which is the position following such partial expansion of assembly 320. Assembly 320 continues to expand until the right hand side of intercell connector 50 comes to rest against a stop pin 359. If pin 359 is in hole 361 as shown in FIG. 1, connector 50 stops at the engaged position. If stop pin 359 was instead further to the right, assembly 320 continues to expand to a third or "expanded" position (not shown) with connector 50 disengaged or lieing wholly on terminal 32, corresponding to the manner in which it lies on terminals 31 when at the position of phantom lines 372.

Vertical cross members 334 are also provided with two vertically aligned holes 354 which are adapted to receive pins 336 (see FIG. 21) of a pole pin fork 364 attached to a pole 362. A handle 360 is attached to the end of pole 362 opposite pin fork 364. Handle 360 is oriented vertically and perpendicular to pole 362 in order to make use of handle 360 easier during the pushing and pulling operations involved in movement of jack 310 into and out of position between connector 50 and wall 30*a*, although it could instead be a simple bicycle type grip mounted on pole 362. Pins 366 are locked in place by two pairs of lock pins 368.

It will be appreciated that the movement of intercell connector 50 to either the right or left in FIG. 20 or 23 can result in disconnection of terminal 32 and 31 from one another. Stop pin holes 361,363,365 and 367 are used to receive stop pins 359 to determine how far intercell connector 50 can move in response to the expansion of jack 310. If it is desired to move connector 50 from a disengaged position, e.g. the position shown in phantom lines 372 of FIG. 20 to the engaged position shown in solid lines in FIG. 20 the stop pin 359 is located in hole 361. If it is then subsequently desired to move intercell connector 50 back to the position shown by phantom lines 372, pin 359 is moved to hole 365 and jack 310 is reversed so that second connector means 316 was on the right and clevis connector 328 on the left. Second contactor means 316 would then be adapted to rest against a wall of the following cell (not shown) and clevis connector 328 would be forced to the left in response to expansion of assembly 320. In order to better understand this alternate position, the piston end 373 of cylinder 322 then assumes the position which is shown in phantom by lines 374 of FIG. 20. When cylinder 322 is in this "reversed" position shown by phantom lines 374, first connector means 312 and 314 would then be put in their middle or "normal" position in which they lie against the right hand side of intercell connectors 50 and expansion of assembly 320 would then result in intercell connector 50 being moved back to the position shown by phantom lines 372, at which point pin 359 (now in hole 365) stops further leftward movement. With stop pin 359 located in holes 365, intercell connector 50 cannot move past stop pin 359 and will therefore be limited in its leftward movement to the position shown by phantom lines 372.

When intercell connector 50 is in the position shown in FIG. 20 (solid lines) bolts 76 of intercell connector 50 are loosened from threaded sleeves 80 so that the upper portion 50*a* and lower portion 50*b* of intercell connector 50 will allow it to move about slightly thereby allowing intercell connector 50 to slide along terminals 31 and 32. A retainer pin 382 and retainer nut 384 prevent bolt 76 from moving completely upward out of threaded sleeve 80. Movement of bolt 76 out of sleeve 80 is not desired because the bottom plates 386 and 388 would then fall off and have to be retrieved and connector 50 would have to be reassembled. Terminals 31 and 32 can preferably have recesses 369 in order to allow the shaft of bolt 76 to move inwardly past the outer ends 378 and 379 of terminals 31 and 32.

FIG. 22 shows a top view of pin fork 358 so that the structure of pin fork 358 can be readily seen to be a handle and two pins. The pins 359 as above described are inserted through holes 351 and 352 in order to set and hold the position of arms 336 and 338 with respect to vertical cross members 334. Snap pins 357 are then inserted through pins 359 to lock fork 358 in position.

Although the invention has been shown and described in terms of the best mode currently envisioned, it will be understood that the jack structure can be varied within the scope of the invention. For example, vertical cross members 334 are shown to be C-shaped even though they could be many other configurations within the scope of the invention. The C-shaped structure as shown is preferred in order to maximize the length of cylinder 322, i.e. to maximize the piston stroke length attainable within a restricted space such as the space 390 between cell wall 30*a* and the leftmost position of the left side of the connector 50, i.e. the left side of connector 50 when in the position shown by phantom lines 372. The means of adjusting the position of arms 336 and 338 with respect to blocks 356 and cross members 334 could be any conventional means such as bolts, screws, cotter pins, straps, or clips.

Suitable for use as cylinder 320 is a 4" diameter, $3\frac{1}{4}$" stroke medium duty hydraulic cylinder such as a 500-pound-per-square-inch-rated, non-magnetic Model No. 66-B Miller hydraulic cylinder. Any other conventional hydraulic cylinder or pneumatic cylinder of equivalent size could be substituted. Suitable for use as hydraulic connectors 342 and 344 are Parker-Hannifin male or female swivel connectors Model No. S-2102-6-6 or Model No. S-2202-6-6. The various structure components of jack 310, such as vertical cross members 334, plates 316 and 348, plates 335, blocks 356, arms 336 and 338, pins 366, pin fork 364, pole 362, and pin fork 358 could all be made of aluminum so as to make jack 310 relatively light and easy to manipulate. These structure components could be made of lighter materials and greater expense or could be made of heavier materials at perhaps less expense, as desired. It is preferred that the components all be made of non-magnetic material so that magnetic forces, which can be enormous at the 150 KA currents involved, do not hinder movement of jack 10 between cells 30.

FIG. 23 is a bottom plan view of the intercell connector bar 50 of FIGS. 1–2 having a top plate 50*a* and a bottom plate held together by a bolt 76 (see FIG. 24) threaded into a threaded sleeve 80 and held captive by a pin nut 82. Plate 50*a* can be slid to the right or left into recesses 69 in the ends 78 and 79 of terminals 32 and 31 (see FIG. 1). Holes 61, 63, 65, and 67 (see FIGS. 1 and 4) are preferably provided to receive stop pins 59 (see FIG. 1) to limit lateral movement of connector 50.

With the benefit above disclosure other modifications in the design of jack will become apparent to those of ordinary skill in the art of designing electrochemical cells and the following claims are to be accorded with the broad scope to which they are therefore entitled. However, before reviewing the claims, some definitions should be first understood.

The word "jack" as used herein means a device which serves to exert an expansive or contractive force, generally in excess of that humanly possible without aid of a tool, against its opposite ends. A jack can exert this force, for example, by mechanical, electrical, hydraulic, pneumatic or even magnetic means. A conventional mechanical or hydraulic car jack and a typical pneumatic service station car lift are well-known examples of "jacks". "Remote-controlled" as used herein with reference to an intercell connector bar jack, jumper system or bolt tightener means controlled by operations performed at a location other than in the space between two electrolytic cells connected in electrical series along the overall current flow path between said cells, i.e. other than "intercell".

FIG. 1 shows an intercell connector system 400 for electrically connecting two adjacent electrolytic cells A and B together in the electrical series described above. The system 400 comprises cathode terminal 32, anode terminal 31, and intercell connector 50. Intercell connector 50 overlaps the adjacent outer ends 378,379 of terminals 31 and 32 to complete an electrical circuit therebetween. The electrical circuit between the cell A and the cell B is from cathode within the cell A to cathode collector plate 40 and from collector 40 through cathode terminal 32 to intercell connector 50 to anode terminal 31 to anode current distributor 34 and then from distributor 34 to the anode conductor rods 36 of cell B as described above. Intercell connector 50 can be selectively moved either to the right or left to interrupt electrical circuit 400. Cathode terminal 32 comprises a horizontal conductive plate projecting from the cell A toward the cell B while anode terminal 31 comprises a horizontal conductive plate projecting from cell B toward cell A. Terminals 31 and 32 are preferably coplanar but spaced some distance apart by a gap therebetween. Cathode terminal 32 includes tabs 406 and recesses 410 in its end closest to anode terminal 31 while anode terminal 31 includes tabs 408 and recesses 412 in the end of anode terminal 31 closest to cathode terminal 32. Tabs 406 and 408 and recesses 410 and 412 are preferably aligned so that intercell connector 50 can move to the right or left in the manner described below. Either one of, but not both of, recesses 410 or 412 could be deleted if connector 50 is always to be moved in the same direction for disengagement. Cathode terminal 32 and anode terminal 31 each include portions defining two pairs of pin locating means such as a four stop holes 361,363,365,367. Stop holes 365 and 367 are located at a position closer to cells A and B than are stop holes 361 and 363. Stop holes 361, 363,365 and 367 serve to receive stop pins 359 (see FIGS. 20 and 24). When stop pin 359 is located in stop holes 361 or 363, intercell connector 50 cannot move past holes 361 or 363. Similarly, when stop pins 359 are placed in stop holes 365 or 367, intercell connector 50 is prevented from moving past that stop hole 365 or 367. If pins 359 are in both holes 361 and 363, connector 50 is locked in its engaged position overlaping both terminals 31 and 32. If, for example, it was desired to move intercell connector 50 from the position shown in FIG. 1 toward cell B, a pair of stop pins 359 would be located in stop holes 367 in anode terminal 31 and no pins 359 would be located in holes 361 in anode terminal 31. Intercell connector 50 would then be moved toward the right past right lock holes 361 and against the stop pin 359 now located in stop holes 367. When intercell connector 50 hits the pair of right stop pins 359 in holes 367, its rightward movement will be stopped. This procedure could equally apply with regard to any movement of intercell connector 50 toward the left cell A. A similar pair of stop pins 359 could be placed in stop holes 365 of cathode terminal 32 to prevent intercell connector 50 from moving to the left past stop holes 365. Stop holes 365 and 363 are located far enough back on terminals 31 and 32 from gap 426 to allow intercell connector 50 to move fully onto either anode terminal 31 or cathode terminal 32 when intercell connector 50 is moved to the right or left, respectively.

The preferred intercell connector 50 (best seen in FIG. 24) comprises an upper conductive portion 50*a*, a lower conductive portion 50*b*, and a fastening means 414. Upper portion 50*a* comprises a pair of parallel plates 416 and 418. Lower portion 50*b* comprises a pair of plates 386 and 388. Fastening means 414 comprises a washer, a captive bolt 76, a retaining nut 384, a retaining nut pin 382, and a threaded sleeve 80. Plates 418 and 386 are conductive such as, for example, copper plates. Plates 416 and 388 are steel back-up plates serving to give added strength to portions 50*a* and 50*b*. Bolt 76 is provided with a threaded end 422 upon which retaining nut 384 is threaded and retaining nut pin 382 is inserted through retaining nut 384 and threaded end 422 so as to hold retaining nut 384 in a fixed position on the lower end of captive bole 76. Prior to this procedure for attaching retaining nut 384 and pin 382, threaded end 422 is inserted through washer 420, plate 416, plate 418 and into gap 426. Bolt 76 is then further inserted into threaded sleeve 80 until threaded end 422 passes completely through threaded sleeve 80 and out the lower end of threaded sleeve 80. Retaining nut 384 is then placed on the portion of threaded end 422 which projects below threaded sleeve 80. Threaded sleeve 80 is held within an opening in lower plates 386 and 388 so that plates 386 and 388 are coupled to upper plates 416 and 418 by bolt 76 and threaded sleeve 80. Bolt 76 cannot move out of threaded sleeve 80 because retaining nut 384 cannot move upwardly past threaded sleeve 80 as would be required to allow bolt 76 to disengage from threaded sleeve 80. However, when bolt 76 is fully loosened, (as shown in FIG. 24) upper portion 50*a* and lower portion 50*b* are able to move about sufficiently to allow upper portion 50*a* to slide along the top of terminal 31 or terminal 32. When bolt 76 is tightened into threaded sleeve 80, such movement is prevented. Bolts 76 of cell connector 50 (see FIG. 23) are aligned within gap 426 adjacent recesses 410 and 412 so that bolt 76 can move to the left into recesses 410 and to the right into recesses 412 when bolt 76 is loosened.

In order to better show the location of intercell connector 50 when moved to a position in which terminals 31 and 32 are no longer connected by connector 50, the left position of intercell connector 50 is shown by phantom lines 372 of FIG. 24. In order to move connector 50 from this left position, shown by phantom lines 372, back to the position shown in solid lines in FIG. 24, it is preferred to use remote-controlled intercell connector jack 310 which has a first contactor means 314. First contactor means 314 is placed in a retracted position (phantom lines 370) against the left hand side of upper portion 50*a* of intercell connector 50 when intercell connector 50 is in the left position shown by lines 372. First contactor 314 is then moved by expansion of jack 310 from this retracted position (shown in phantom by lines 370) to the position shown in solid lines in FIG. 24. As previously described, jack 310 expands so as to move contactor 314 away from a support leg 340. Support leg 340 is attached to a second contactor 316 (see FIG. 20) which rests against the right wall of left cell A so as to prevent support leg 340 from moving to the left when jack 310 is expanding. Instead, when jack 310 is expanded, first contactor 314 moves to the right and shoves intercell connector 50 to the right. The final location of intercell connector 50 is determined by the location of stop pins 359. If stop pins 359 are located in the stop holes 361 of anode terminal 31, rightward movement of intercell connector 50 will stop when intercell connector 50 assumes the position shown in solid lines in FIG. 24. If stop pins 359 are not in holes 367 and stop pins 359 are in stop holes 367 connector 50 will stop against pins 354 in a rightmost position.

Plate 416 and 388 serves as back-up plates and are preferably made of steel or other non-flexible strong metal while plates 418 and 386 are conductive plates and therefore are preferably bars of some highly conductive flexibly metal such as copper. It will be understood that upper portion 50*a* of intercell connector 50 could be a single conductive plate. Similarly, lower portion 50*b* could be a single conductive plate. In fact, only one of portions 50*a* and 50*b* need be conductive. However, if only one of portions 50*a* and 50*b* is conductive, the one portion which is conductive will have to be more substantial than it would be if the other portion was also conductive.

The particular number of bolts 76, washers 420, threaded sleeves 80, nuts 384 and pins 382, is preferably selected so as to result in a contact pressure between plates 418,386 and terminals 31,32 of greater than about 1,000 pounds per square inch of contact area therebetween and preferably a contact pressure within the range of from about 2,500 to about 3,500 pounds per square inch. The size of plates 418 and 386 is preferably sufficient to yield a contact area between plates 418,386 and terminals 31,32 of greater than 2 square inches per kiloampere of total current. "Total cell current" as used herein means the total current flow between left cell A and right cell B through the intercell connector system 410. More preferably, the contact area between plates 418,386 and terminals 31,32 is greater than 3 square inches per kiloampere of total cell current and most preferably is within the range of from about 3 to about 5 square inches per kiloampere of total cell current. The precise contact pressure and contact area are selected so that plates 418 and 386 are placed against each of terminals 31 and 32 with at least a surface-deforming force. "Surface-deforming force" as used herein means a force sufficient to flatten out a major portion of the surface irregularities, if any, of terminals 31 and 32. It will be understood by those of ordinary skill in the art that deformation of the surface of terminals 31 and 32 in the area of contact when plates 418 and 386 is desirable in order to maximize the conductivity across the surface between intercell connector 50 and terminals 31 and 32.

In order to handle the larger current of the newer high capacity electrolytic cells presently being developed, it is preferred that the cathode terminal 32 projects in a horizontal plane from left cell A toward right cell B along a width (direction of current flow) within the range of from about 5" (1 dm) to about 12" (3 dm) and a length (direction transverse to current flow) within the range of from about 4' (1 m) to about 15' (5 m) and that anode terminal 31 projects in the horizontal plane, from right cell B toward left cell A along a width (direction of current flow) within the range of from about 5' (1 dm) to about 12" (3 dm) and a length (direction transverse to current flow) within the range of from about 4' (1 m) to about 15' (5 m) and that intercell connector 50 is oriented along that horizontal plane for conductively contacting terminals 31 and 32 over a length greater than about ⅓ the length of terminals 31 and 32.

Although only one cathode terminal 32 and one anode terminal 31 are shown in the preferred embodiments, it will be understood that this is done so as to simplify the description of intercell connector system 410 rather than for purposes of limitation to a single anode and cathode terminal. In fact, the most preferred embodiment includes two intercell connection systems 410 (see FIGS. 2, 4, 7, 13, 14, 19, and 20). That is, intercell connection system 410 would be run parallel to another intercell connection system (see FIG. 20) including a second cathode terminal 32 and second anode terminal 31 and a second intercell connector 50 all horizontally aligned in a different horizontal plane than the plane of intercell connection system 410. Another equivalent embodiment which is somewhat less preferred but which is nevertheless within the scope of the invention is an embodiment wherein recesses 410 and 412 extend completely across terminals 31 and 32 thereby dividing terminals 31 and 32 each into multiple tab-like portions 406 and 408. In FIG. 23 tab-like portions 406 and 408 merely extend part way across terminals 32 and 31, respectively, a sufficient distance to enable intercell connector 50 to move completely to the left of or right of gap 426 when it is moved to the left or right respectively. If recesses 410 and 412 extend further, it will be appreciated that intercell connector 50 could be moved further to the right or left, if desired. However, it is more preferred not to fully extend recesses 410 and 412. By only partly extending recesses 410 and 412, a solid cathode plate 402 and a solid anode plate 404 will be provided toward left cell A and toward right cell B from recesses 410 and 412, respectively. Cathode plate 402 and anode plate 404 can serve as lengthwise current distributors to thereby reduce the amount of metal needed in cathode current collector 40 and anode current distributor 34.

Looking again at FIG. 24, it is seen that the electrical flow path from left cell A to right cell B through intercell connector system 410 is extremely straight and direct and therefore utilizes a minimum of conductive material. This short and direct current flow path therefore results in a major savings in construction expense when building an electrolysis plant comprising a multiplicity of electrolytic cells connected in electrical series. In order to disconnect right cell B and left cell A it is normally preferred to utilize a jumper system which will contact either cathode plate 402 or anode plate 404 depending on which of cells A and B is to be removed from the electrical series circuit previously mentioned. For example, in FIGS. 1-5, plate 402 of cell A is contacted and cell B is disconnected. It is preferred that a remote-controlled jumper system, such as system 20, 20*a* or 20*b* described above, be utilized to perform that contacting operation so that extra conductive material need not be provided merely for purposes of carrying current lengthwise across terminals 31 and 32 during "jumping" operations. In a copending, commonly invented, commonly assigned application, such a system is disclosed. Basically, as respects the present invention, that system provides a pair of conductor arms which are planted by hydraulic, pneumatic or bolt means to the top and bottom of cathode plate 402 or anode plate 404 as appropriate for jumping one of cells A and B. The arms of such a jumper system are sized so as to have sufficient conductivity and surface area to handle the extremely large currents (e.g. 150 KA or more) which pass between cells A and B. The plates 418 and 386 preferably have a thickness within the range of from about 3/16 to about $\frac{3}{4}''$. Cathode terminal 32 and anode terminal 31 preferably have a thickness within the range of from about $\frac{3}{8}''$ to about $1\frac{1}{2}''$. The plates 418 and 386 also preferably have a width within the range of from about $2\frac{1}{2}''$ to about 6" and a length within the range of from about 4' to about 15'.

Although the invention has been primarily described in terms of the best mode currently envisioned, other equivalent embodiments will be apparent to the person of ordinary skill in the art of contructing electrolytic cells and such equivalents are covered in the following claims.

From the above description of the structural embodiments and the operation which each part performs, the overall operation of the apparatus is quite clear and self-evident. However, it will be appreciated that minor modifications may be made to the apparatus and method in keeping with the broad scope of the invention below claimed. The following claims are intended to cover all such equivalent modifications. For example, while the invention is disclosed and claimed in terms of chloralkali diaphragm cells, it is intended to cover all similar electrolytic cells. Similarly, while the invention is descirbed in terms of a horizontal terminal and horizontal jumper system conductor arms, it would be equally applicable to vertical terminals and vertical jumper system conductor arms.

As used herein the "overall" direction of current flow is from left to right in FIGS. 1, 2, and 5 and the "transverse" direction is up or down in FIGS. 1, 2, and 4. FIGS. 3 and 6 are taken along a "transverse" plane. "Transverse" can be either perpendicular or oblique to the "overall" direction.

What is claimed is:

1. A method of by-passing and disconnecting one of a plurality of electrolytic cells connected in electrical series circuit while maintaining the remaining cells of said electrical series in operation, each of said cells having a cathode terminal, an anode terminal, and an intercell conductor for electrically connecting said anode and cathode terminals, which method comprises the steps of:

(a) positioning a jumper aside said series of cells;

(b) inserting a first portion of said jumper having two spaced apart members between a cell to be disconnected and the preceding cell in said series of cells;

(c) inserting a second portion of said jumper having two spaced apart members between said cell to be disconnected and the succeeding cell in said series of cells;

(d) contacting the cathode terminal of said preceding cell with said inserted first portion of said jumper at a location between said preceding cell and said cell to be disconnected while said cell to be disconnected is still fully connected to said preceding cell by remotely moing said two spaced apart members of said first jumper portion towards each other about and into contact with said cathode cell terminal of said preceding cell;

(e) contacting the anode terminal of said succeeding cell with said inserted second portion of said jumper at a location between said succeeding cell and said cells to be disconnected while said cell to be disconnected is still fully connected to said succeeding cell by remotely moving said two spaced apart members of said second jumper portions toward each other about and into contact with said anode cell terminal of said succeeding cell;

(f) electrically connecting said first and second jumper portions so as to electrically by-pass said cell to be disconnected; and (g) remotely disconnecting said cell to be disconnected from said preceding and succeeding cells to thereby electrically by-pass said disconnected cell through said jumper.

2. The method of claim 1 wherein the area of contact between said first and second jumper portions contact and said cathode and anode terminals, respectively, is at least about 2 square inches per kiloampere of current passing through said area of contact when said cell to be disconnected is disconnected.

3. The method of claim 2 wherein said area of contact is at least twice as long as wide.

4. The method of claim 1 wherein said first and second jumper portions contact said cathode terminal and anode terminal, respectively, with a contact pressure of at least about 3,000 pounds per square inch.

5. The method of claim 1 wherein said remote disconnection is performed in spaces between said cell to be disconnected and said preceding and following cells along the path of overall current flow in said series.

6. The method of claim 5 wherein said contacting steps, electrical connection step and said disconnecting step all occur in but are all remotely controlled from outside the spaces between said cell to be disconnected and said preceding and succeeding cells.

7. The method of claim 6 wherein said disconnecting step further comprises:

(a) remotely unfastening at least one of said intercell conductors between said cell to be disconnected and each of said preceding and following cells;

(b) remotely moving said unfastened intercell conductors from a position contacting both one of said preceding and following cells and said cell to be disconnected to a position contacting only one of said preceding cell, following cell and cell to be disconnected.

8. The method of claim 6 wherein the contact pressure between each of said two first jumper portions and said cathode cell terminal and the contact pressure between each of said two second jumper portions and said anode cell terminal each are at least about 3,000 pounds per square inch.

9. The method of claim 6 wherein the area of contact between each of said first jumper portions and said cathode cell terminal and the area of contact between each of said two second jumper portions and said anode cell terminal each are at least about 2 square inches per kiloampere of current passing through said area of contact when said cell to be disconnected is disconnected.

10. The method of claim 6 wherein the contact pressure between said first and second jumper portions and said cathode and anode terminals, respectively, is sufficient to deform surface irregularities.

11. The method of claim 6 wherein said first and second jumper portions contact said cathode and anode terminals, respectively, over a contact area of a length at least about one-third the length of said cathode and anode terminals.

12. The method of claim 6 wherein said step of loosening comprises the steps of:

(a) remotely positioning at least one loosening means between said cell to be disconnected and said preceding and succeeding cells;

(b) remotely loosening said intercell connector;

(c) remotely moving said intercell connector from a position engaging both said cell to be disconnected and one of said preceding and following cells to a position engaging no more than one of said cells thereby electrically disconnecting said cell to be disconnected.

13. The method of claim 12 wherein said step of remotely moving said intercell connector comprises the steps of:

(a) remotely inserting an intercell connector jack between said loosened connector and one of the cells to which said loosened intercell connector is attached; and (b) remotely expanding said jack.

14. The method of claim 13 which further comprises the step of:

moving said intercell connector onto one of said terminals responsive to said jack expansion.

15. The method of claim 14 wherein said jack and said loosening device are inserted between said cells from the opposite side of said series of cells from that from which said jumper is inserted.

16. The method of claim 12 wherein said loosening device and said jumper are inserted between said cells from opposite sides of said series of cells.

17. The method of claim 12 wherein said step of moving said loosened intercell connector comprises the step of sliding said intercell connector longitudinally off of both of said anode and cathode cell terminals in a direction transverse to the path of overall current flow through said electrical series of cells.

18. The method of claim 17 wherein said movement of said intercell connector is horizontal.

19. The method of claim 18 wherein said movement of said intercell connector is vertical.

20. The method of claim 1 further comprising the steps of (a) remotely connecting a cell in the position previously occupied by said cell to be disconnected, to said preceding and succeeding cells while maintaining said first and second jumper portions in contact with said cathode and anode terminals, respectively;

(b) remotely releasing pressure between said jumper portions and said terminals; and (c) remotely removing said first and second jumper portions from between said connected cell and said preceding and following cells.

21. The method of claim 20 wherein said connected cell is not the cell previously disconnected.

22. The method of claim 20 wherein said connected cell is said cell previously disconnected.

23. The method of claim 1 wherein said step of positioning said jumper includes moving said jumper in a direction parallel to the overall path of current flow in said electrical series.

24. The method of claim 23 wherein said direction of movement of said jumper during positioning is horizontal.

25. The method of claim 23 wherein said step of inserting comprises the step of moving said jumper in a direction perpendicular to the overall direction of current flow in said electrical series.

26. The method of claim 25 wherein said direction of movement during positioning and insertion is horizontal.

27. The method of claim 1 wherein said insertion of said jumper portions is horizontal.

28. A method of disconnecting an intercell connector which is held by a plurality of fastening devices in a position connecting two electrolytic cells, which method comprises the steps of:

(a) aligning a loosening device adjacent said cells;

(b) inserting said device between said two cells;

(c) remotely sequentially positioning said device adjacent each of said plurality of fastening means;

(d) remotely sequentially activating said device to loosen each of said plurality of fastening means when said device is positioned adjacent that particular fastening means;

(e) remotely inserting a jack between said loosened connector and one of said cells; and (f) remotely expanding said jack so as to move said loosened conductor out of engagement with at least one of said two cells thereby breaking the electrical contact.

29. The method of claim 28 wherein said sequential position and sequential activation steps collectively comprise the following steps:

(a) remotely positioning said device adjacent a first one of said fastening means;

(b) activating said positioned device while maintaining said device adjacent said first fastening means so as to loosen said fastening means;

(c) deactivating said device;

(d) repositioning said deactivated device adjacent a second one of said plurality of fastening means;

(e) reactivating said repositioned deactivated device while maintaining said device adjacent said second fastening means so as to loosen said second fastening means; and (f) deactivating said reactivated device;

(g) sequentially repeating said repositioning and activation steps (d), (e), and (f) for every other one of said plurality of fastening means to thereby loosen said intercell connection from at least one of said cells.

30. The method of claim 28 which further comprises the step of:

remotely moving said moved loosened intercell connector back into contact with said at least one of said two cells from which it was previously disconnected.

31. The method of claim 30 wherein said movement back into contact comprises the steps of:

(a) remotely positioning said device adjacent a first one of said fastening means;

(b) activating said positioned device while maintaining said device adjacent said first fastening means so as to loosen said fastening means;

(c) deactivating said device;

(d) repositioning said deactivated device adjacent a second one of said plurality of fastening means;

(e) reactivating said repositioned deactivated device while maintaining said device adjacent said second fastening means so as to loosen said second fastening means; and (f) deactivating said reactivated device;

(g) sequentially repeating said repositioning and activation steps (d), (e), and (f) for every other one of said plurality of fastening means to thereby loosen said from at least one of said cells.

32. A method of moving a loosened intercell connector from a position connecting two electrolytic cells in electrical series to a position not connecting said two cells, which method comprises the steps of:

(a) inserting an intercell connector jack between said loosened connector and one of the cells to which said loosened intercell connector is attached; and (b) remotely expanding said jack.

33. The method of claim 32 which further comprises the step of:

moving said intercell connector onto one of said terminals responsive to said jack expansion.

34. The method of claim 32 wherein said expansion is remotely fluidically controlled.

35. A method of by-passing and disconnecting one of a plurality of electrolytic cells connected in electrical series circuit while maintaining the remaining cells of said electrical series in operation, each of said cells having a cathode terminal, an anode terminal, and an intercell conductor for electrically connecting said anode and cathode terminals, which method comprises the steps of:

(a) positioning a jumper aside said series of cells;

(b) inserting a first portion of said jumper vertically downwardly between a cell to be disconnected and the preceding cell in said series of cells;

(c) inserting a second portion of said jumper vertically downwardly between said cell to be disconnected and the succeeding cell in said series of cells;

(d) contacting the cathode terminal of said preceding cell with said inserted first portion of said jumper at a location between said preceding cell and said cell to be disconnected while said cell to be disconnected is still fully connected to said preceding cell;

(e) contacting the anode terminal of said succeeding cell with said inserted second portion of said jumper at a location between said succeeding cell and said cells to be disconnected while said cell to be disconnected is still fully connected to said succeeding cell;

(f) electrically connecting said first and second jumper portions so as to electrically by-pass said cell to be disconnected; and (g) remotely disconnecting said cell to be disconnected from said preceding and succeeding cells to thereby electrically by-pass said disconnected cell through said jumper.

36. A method of by-passing and disconnecting one of a plurality of electrolytic cells connected in electrical series circuit while maintaining the remaining cells of said electrical series in operation, each of said cells having a cathode terminal, an anode terminal, and an intercell conductor for electrically connecting said anode and cathode terminals, which method comprises the steps of:

(a) positioning a jumper aside said series of cells;

(b) inserting a first portion of said jumper vertically upwardly between a cell to be disconnected and the preceding cell in said series of cells;

(c) inserting a second portion of said jumper vertically upwardly between said cell to be disconnected and the succeeding cell in said series of cells;

(d) contacting the cathode terminal of said preceding cell with said inserted first portion of said jumper at a location between said preceding cell and said cell to be disconnected while said cell to be disconnected is still fully connected to said preceding cell;

(e) contacting the anode terminal of said succeeding cell with said inserted second portion of said jumper at a location between said succeeding cell and said cells to be disconnected while said cell to be disconnected is still fully connected to said succeeding cell;

(f) electrically connecting said first and second jumper portions so as to electrically by-pass said cell to be disconnected; and (g) remotely disconnecting said cell to be disconnected from said preceding and succeeding cells to thereby electrically by-pass said disconnected cell through said jumper.

37. A method of by-passing and disconnecting one of a plurality of electrolytic cells connected in electrical series circuit while maintaining the remaining cells of said electrical series in operation, each of said cells having a cathode terminal, an anode terminal, and an intercell conductor for electrically connecting said anode and cathode terminals, which method comprises the steps of:

(a) positioning a jumper aside said series of cells;

(b) inserting a first portion of said jumper between a cell to be disconnected and the preceding cell in said series of cells;

(c) inserting a second portion of said jumper between said cell to be disconnected and the succeeding cell in said series of cells;

(d) contacting the cathode terminal of said preceding cell with said inserted first portion of said jumper at a location between said preceding cell and said cell to be disconnected while said cell to be disconnected is still fully connected to said preceding cell;

(e) contacting the anode terminal of said succeeding cell with said inserted second portion of said jumper at a location between said succeeding cell and said cells to be disconnected while said cell to be disconnected is still fully connected to said succeeding cell;

(f) electrically connecting said first and second jumper portions so as to electrically by-pass said cell to be disconnected;

(g) remotely positioning at least one loosening means between said cell to be disconnected and said preceding and succeeding cell;

(h) remotely loosening said intercell connector; and (i) remotely moving said intercell connector from a position engaging both said cell to be disconnected and one of said preceding and following cells to a position engaging no more than one of said cells to thereby electrically by-pass said disconnected cell through said jumper.

38. The method of claim 37 wherein said step of remotely moving said intercell connector comprises the steps of:

(a) remotely inserting an intercell connector jack between said loosened connector and one of the cells to which said loosened intercell connector is attached; and (b) remotely expanding said jack.

39. The method of claim 38 which further comprises the step of:

moving said intercell connector onto one of said terminals responsive to said jack expansion.

40. The method of claim 39 wherein said jack and said loosening device are inserted between said cells from the opposite side of said series of cells from that from which said jumper is inserted.

41. The method of claim 40 wherein said loosening device and said jumper are inserted between said cells from opposite sides of said series of cells.

42. The method of claim 37 wherein said step of moving said loosened intercell connector comprises the step of sliding said intercell connector longitudinally off of both of said anode and cathode cell terminals in a direction transverse to the path of overall current flow through said electrical series of cells.

43. The method of claim 42 wherein said movement of said intercell connector is horizontal.

44. The method of claim 43 wherein said movement of said intercell connector is vertical.

45. The method of claim 37 wherein said insertion of said jumper portions is horizontal.

46. The method of claim 37 wherein said insertion of said jumper portions is vertically downward.

47. The method of claim 37 wherein said insertion of said jumper portions is vertically upward.

* * * * *

UNITED STATES PATENT AND TRADEMARK OFFICE

CERTIFICATE OF CORRECTION

PATENT NO. : 4,324,634

DATED : April 13, 1982

INVENTOR(S) : Morton S. Kircher and Steven J. Specht

It is certified that error appears in the above-identified patent and that said Letters Patent are hereby corrected as shown below:

Column 4, line 9, delete "travel" and insert therefor --level--;

Column 8, line 34, delete "tha" and insert therefor --the--;

Column 9, line 40, delete "and" and insert therefor --or--;

Column 10, line 1, delete "are" and insert therefor --and--;

Column 12, line 58, delete "guage" and insert therefor --gauge--;

Column 13, line 67, delete "20*a)" and insert therefor --20(a)--;

Column 17, line 44, delete "move" and insert therefor --moves--;

Column 18, line 46, delete "vertial" and insert therefor --vertical--;

Column 18, line 17, delete "the" and insert therefor --to--;

Column 20, line 4, delete "with" and insert therefor --within--;

Column 21, line 20, delete "336" and insert --366-;

Column 24, line 30, delete "bole" and insert therefor --bolt--;

Column 26, line 4, delete "5' " and insert therefor --5"--;

Column 27, line 20, delete "contructing" and insert therefor --constructing--;

UNITED STATES PATENT AND TRADEMARK OFFICE

CERTIFICATE OF CORRECTION

PATENT NO. : 4,324,634

DATED : April 13, 1982

INVENTOR(S) : Morton S. Kircher and Steven J. Specht

It is certified that error appears in the above—identified patent and that said Letters Patent is hereby corrected as shown below:

Column 27, line 67, delete "moing" and insert --moving--;

Column 30, line 51, in Claim 29, delete "connection" and insert therefor --connector--;

Column 31, line 9, in Claim 31, after "said" (first occurrence), and before "from" insert --intercell connector--.

Signed and Sealed this

*Thirteenth* Day of *July 1982*

[SEAL]

*Attest:*

GERALD J. MOSSINGHOFF

*Attesting Officer*

*Commissioner of Patents and Trademarks*